US011192235B2

(12) United States Patent
Steele et al.

(10) Patent No.: US 11,192,235 B2
(45) Date of Patent: Dec. 7, 2021

(54) TOOL BIT CASE WITH MODULAR COMPONENTS

(71) Applicant: Milwaukee Electric Tool Corporation, Brookfield, WI (US)

(72) Inventors: Michael S. Steele, Pewaukee, WI (US); Steven G. Melnyk, Cedarburg, WI (US); Edward Landon, Slinger, WI (US); James Grow, Milwaukee, WI (US); Ryan Rudzinski, Thiensville, WI (US); Brian Dieck, Winneconne, WI (US); Adam Eller, Brookfield, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 78 days.

(21) Appl. No.: 16/684,890

(22) Filed: Nov. 15, 2019

(65) Prior Publication Data

US 2020/0078928 A1 Mar. 12, 2020

Related U.S. Application Data

(63) Continuation of application No. 15/626,545, filed on Jun. 19, 2017, now Pat. No. 10,500,711, which is a (Continued)

(51) Int. Cl.
*B25H 3/00* (2006.01)
*B25H 3/02* (2006.01)
(Continued)

(52) U.S. Cl.
CPC ..... *B25H 3/003* (2013.01); *B25H 3/021* (2013.01); *B65D 25/108* (2013.01); (Continued)

(58) Field of Classification Search
CPC ..... B25H 3/003; B25H 3/021; B25H 3/006; B25H 3/02; B25H 3/00; B25H 3/04; (Continued)

(56) References Cited

U.S. PATENT DOCUMENTS 33,253 A 9/1861 Lewis
337,888 A 3/1886 Swan
(Continued)

*Primary Examiner* — Rafael A Ortiz
(74) *Attorney, Agent, or Firm* — Michael Best & Friedrich LLP

(57) ABSTRACT

A merchandise product includes a tool bit case having first and second housing members pivotally coupled together. The tool bit case includes a first and a second modular tool bit holder. The first modular tool bit holder is movably coupled to the first housing member. The second modular tool bit holder is movably coupled to the first or second housing member. The modular tool bit holders are each moveable between a storage position and an in-use position. The merchandise product further includes a clamshell packaging having a front clamshell portion coupled to a rear clamshell portion. The clamshell packaging fully encloses the tool bit case between the front and rear clamshell portions while the tool bit case is in an open position. The tool bit case further includes the first modular bit holder in the storage position and the second modular bit holder in the in-use position.

20 Claims, 15 Drawing Sheets

Related U.S. Application Data continuation of application No. 14/467,656, filed on Aug. 25, 2014, now Pat. No. 9,694,489.

(51) Int. Cl.

| | |
|---|---|
| ***B65D 25/10*** | (2006.01) |
| ***B65D 43/16*** | (2006.01) |
| ***B65D 55/02*** | (2006.01) |
| ***B65D 25/20*** | (2006.01) |

(52) U.S. Cl.

CPC ..... *B65D 25/205* (2013.01); *B65D 43/164* (2013.01); *B65D 55/02* (2013.01)

(58) Field of Classification Search

CPC ..... B25H 3/06; B25H 3/023; B65D 25/108; B65D 43/164; B65D 55/02; B65D 25/205; B65D 5/50; B65D 5/52; B65D 25/54; B65D 55/024

USPC ..... 206/372–375, 377–379, 234, 349, 509, 206/770, 769, 749, 765, 738, 773, 774, 206/772, 15.2, 736

See application file for complete search history.

(56) References Cited

U.S. PATENT DOCUMENTS 858,393 A 7/1907 Horner
2,228,493 A 1/1941 Will
2,228,921 A 1/1941 Frederick
2,287,425 A 6/1942 Fox
2,370,928 A 3/1945 Baldanza
2,508,951 A 5/1950 Kazimier
2,687,157 A 8/1954 Cowan
2,800,220 A 7/1957 Hawver
3,061,136 A 10/1962 Sterngart
D194,339 S 1/1963 Millard
3,360,644 A 12/1967 Lillebostad
3,583,556 A 6/1971 Wagner
4,191,291 A 3/1980 Brown
4,211,337 A 7/1980 Weavers et al.
4,304,328 A 12/1981 Pilat
4,469,225 A 9/1984 Takahashi
4,573,575 A 3/1986 Bergrath et al.
4,598,822 A 7/1986 Hemmings
4,619,364 A 10/1986 Czopor, Jr.
4,660,719 A 4/1987 Peterson et al.
4,807,760 A 2/1989 Sussman
4,955,478 A 9/1990 Rau et al.
5,006,066 A 4/1991 Rouse
5,056,661 A 10/1991 Balzano
5,098,235 A * 3/1992 Svetlik ..... B25H 3/003 206/379
5,108,287 A 4/1992 Yee et al.
5,123,532 A 6/1992 Rau
5,190,154 A 3/1993 Reusch
5,312,250 A 5/1994 Ellman et al.
5,368,164 A 11/1994 Bennett et al.
5,429,235 A 7/1995 Chen
5,472,110 A 12/1995 Boyd et al.
D367,759 S 3/1996 Jacobson
5,497,875 A 3/1996 Kuo
5,520,400 A 5/1996 Hung
5,526,929 A 6/1996 Wei
5,562,208 A 10/1996 Hasler et al.
5,570,784 A 11/1996 Sidabras et al.
5,641,066 A 6/1997 Mascaro
5,676,254 A 10/1997 Cheng et al.
5,758,769 A 6/1998 Vasudeva
5,758,770 A 6/1998 Moneta
5,782,150 A 7/1998 Huang
5,813,532 A 9/1998 Kheradpir et al.
5,839,579 A 11/1998 Lee
D403,508 S 1/1999 Kheradpir et al.
D403,566 S 1/1999 Marsh
D406,057 S 2/1999 Hager
5,887,715 A 3/1999 Vasudeva
5,957,285 A 9/1999 Lai
D418,977 S 1/2000 Streich
6,032,796 A 3/2000 Hopper et al.
6,050,409 A 4/2000 Delbeck et al.
6,068,123 A 5/2000 Chen
D426,705 S 6/2000 Fang
6,070,732 A 6/2000 Chen
D427,435 S 7/2000 Gibson et al.
D428,699 S 8/2000 Gibson et al.
6,105,767 A 8/2000 Vasudeva
6,105,769 A 8/2000 Chen
D431,359 S 10/2000 Lapidus
D432,304 S 10/2000 Zurwelle et al.
D432,790 S 10/2000 Streich et al.
D433,627 S 11/2000 Vasudeva
D436,441 S 1/2001 Lapidus
D437,684 S 2/2001 Streich et al.
D439,408 S 3/2001 Gibson et al.
6,213,296 B1 4/2001 Streich et al.
6,237,767 B1 5/2001 Lee
D446,018 S 8/2001 Streich et al.
D447,634 S 9/2001 Snider
D448,167 S 9/2001 Pangerc et al.
6,283,291 B1 9/2001 Vasudeva et al.
6,322,177 B1 11/2001 Vasudeva
6,405,864 B1 6/2002 Streich et al.
6,415,922 B1 7/2002 Lee
D466,295 S 12/2002 Snider
6,516,639 B1 2/2003 Margetts et al.
6,547,074 B1 4/2003 Chen
D477,464 S 7/2003 Cang
D477,714 S 8/2003 Cunningham et al.
D477,912 S 8/2003 Cunningham et al.
D478,209 S 8/2003 Chen
D478,725 S 8/2003 Vasudeva et al.
6,626,295 B1 9/2003 Vasudeva
D481,868 S 11/2003 Cunningham et al.
D484,309 S 12/2003 Lee
6,679,381 B1 1/2004 Bush
6,698,608 B2 3/2004 Parker et al.
6,698,609 B2 3/2004 Pangerc et al.
6,755,302 B1 6/2004 Streich et al.
6,779,681 B2 8/2004 Doerfler et al.
D502,316 S 3/2005 Chen
6,863,175 B2 3/2005 Gelardi
6,868,967 B2 3/2005 Lam
6,880,698 B2 4/2005 Fiore et al.
6,905,020 B2 6/2005 Chang
6,913,149 B2 7/2005 Gelardi et al.
6,942,095 B2 9/2005 Chen
6,953,114 B2 10/2005 Wang
RE38,905 E 12/2005 Wei
6,978,890 B2 12/2005 Pangerc et al.
6,988,616 B2 1/2006 Chen
6,994,214 B2 2/2006 Yang
7,032,750 B2 4/2006 Amtenbrink
7,159,712 B1 1/2007 Chen
7,225,923 B2 6/2007 Hallee et al.
7,249,676 B2 7/2007 Wang
7,316,309 B2 1/2008 Streich et al.
7,322,470 B2 1/2008 Brunson
7,331,455 B2 2/2008 Lin
D563,669 S 3/2008 Bosak et al.
7,367,451 B2 5/2008 Pendergraph et al.
D572,479 S 7/2008 Buck et al.
7,401,698 B2 7/2008 Dost et al.
7,401,700 B2 7/2008 Dost et al.
7,600,640 B2 10/2009 Hallee et al.
7,661,526 B2 2/2010 Lin
7,677,391 B2 3/2010 Pistor et al.
7,780,016 B1 8/2010 Cornwell et al.
D624,317 S 9/2010 Wenchel et al.
7,806,264 B1 10/2010 Lai
7,931,143 B1 * 4/2011 Lin ..... B25H 3/021 206/373
D636,996 S 5/2011 Kokawa et al.
8,069,984 B2 12/2011 Larson et al.

(56) References Cited

U.S. PATENT DOCUMENTS

| | | | | |
|---|---|---|---|---|
| 8,267,245 | B2 | 9/2012 | Kotula et al. | |
| 8,276,752 | B1 | 10/2012 | Meng | |
| 8,286,792 | B2 | 10/2012 | Serpico et al. | |
| 8,292,069 | B2 | 10/2012 | Silva Rubio et al. | |
| 8,297,464 | B2 | 10/2012 | Grenier et al. | |
| D670,495 | S | 11/2012 | Lorek et al. | |
| 8,336,708 | B2 | 12/2012 | Potterfield et al. | |
| 8,505,729 | B2 | 8/2013 | Sosnovsky et al. | |
| D691,801 | S | 10/2013 | Lin | |
| D702,679 | S | 4/2014 | Li | |
| D709,699 | S | 7/2014 | Hsu | |
| D710,104 | S | 8/2014 | Tivoly | |
| 2002/0153203 | A1 | 10/2002 | Pangerc | |
| 2004/0035746 | A1 | 2/2004 | Lee et al. | |
| 2004/0069668 | A1* | 4/2004 | Finnigan | B25H 3/003 206/372 |
| 2004/0099554 | A1 | 5/2004 | Pangerc et al. | |
| 2004/0154942 | A1 | 8/2004 | Streich et al. | |
| 2005/0029140 | A1 | 2/2005 | Wang | |
| 2005/0044904 | A1 | 3/2005 | Horngren et al. | |
| 2005/0045509 | A1* | 3/2005 | Chen | B25H 3/003 206/373 |
| 2005/0061694 | A1 | 3/2005 | Ting | |
| 2005/0077198 | A1 | 4/2005 | Wikle et al. | |
| 2005/0126944 | A1 | 6/2005 | Wang | |
| 2005/0166692 | A1 | 8/2005 | Wang | |
| 2005/0178686 | A1 | 8/2005 | Pangerc et al. | |
| 2005/0211587 | A1 | 9/2005 | Chen | |
| 2005/0241974 | A1 | 11/2005 | Chen | |
| 2005/0269340 | A1 | 12/2005 | Chuan | |
| 2006/0011624 | A1 | 1/2006 | Shih | |
| 2006/0065658 | A1 | 3/2006 | Brunson | |
| 2007/0074984 | A1 | 4/2007 | Liu | |
| 2007/0262876 | A1 | 11/2007 | Marsilio et al. | |
| 2008/0035508 | A1 | 2/2008 | Streich et al. | |
| 2008/0035510 | A1 | 2/2008 | Brunson | |
| 2008/0060967 | A1 | 3/2008 | Chang | |
| 2008/0135447 | A1 | 6/2008 | Wang | |
| 2008/0210593 | A1 | 9/2008 | Cornwell et al. | |
| 2009/0266730 | A1 | 10/2009 | Lin | |
| 2011/0073516 | A1 | 3/2011 | Zelinskiy | |
| 2012/0248131 | A1 | 10/2012 | Wang | |
| 2012/0267374 | A1 | 10/2012 | Kotula et al. | |
| 2014/0023475 | A1 | 1/2014 | Meyers | |
| 2014/0231307 | A1 | 8/2014 | Wen | |
| 2015/0258676 | A1 | 9/2015 | Wang | |

* cited by examiner

TOOL BIT CASE WITH MODULAR COMPONENTS

CROSS-REFERENCE TO RELATED APPLICATIONS

This application is a continuation patent application to U.S. patent application Ser. No. 15/626,545, filed Jun. 19, 2017, now U.S. Pat. No. 10,500,711, which is a continuation patent application to U.S. patent application Ser. No. 14/467,656, filed Aug. 25, 2014, now U.S. Pat. No. 9,694,489, the entire contents of both of which are incorporated herein by reference.

BACKGROUND

The application relates to storage devices and, more particularly, to cases for storing tool bits.

Containers for storing tool bits such as drill bits, impact screwdriver bits, torque bits, and the like are known. Such containers typically include retaining means for holding the tool bits in an organized manner. Conventionally, the retaining means are not adaptive to various different types of tool bits. In addition, conventional retaining means do not provide interchangeability for various different types of retaining means.

SUMMARY

In one embodiment, the invention provides a tool bit case including a first housing member and a second housing member pivotally coupled together. Each housing member includes a base and sidewalls extending from the base. The tool bit case also includes a plurality of retainers located along opposing sidewalls of the first housing member. Each retainer on a first sidewall is aligned with a corresponding retainer on a second sidewall that is opposite the first sidewall. The tool bit case further includes a modular tool bit holder that is engageable with a corresponding pair of retainers of the plurality of retainers. The modular tool bit holder is pivotable relative to the first housing member between a storage position and an upright position. When the modular tool bit holder is in the storage position, the modular tool bit holder blocks access to at least one retainer adjacent the corresponding pair of retainers, and when the modular tool bit holder is in the upright position, the at least one retainer is accessible.

In another embodiment, the invention provides a tool bit case including a first housing member and a second housing member pivotally coupled together. Each housing member includes a base and sidewalls extending from the base. The tool bit case also includes a plurality of retainers located along opposing sidewalls of the first housing member. Each retainer on a first sidewall is aligned with a corresponding retainer on a second sidewall that is opposite the first sidewall. The tool bit case further includes a modular tool bit holder that is engageable with the plurality of retainers to secure the modular tool bit holder within the first housing member. The modular tool bit holder is pivotable relative to the first housing member between a storage position and an upright position. The modular tool bit holder engages one retainer on the first sidewall and one retainer on the second sidewall while in the upright position, and engages more than one retainer on the first sidewall while in the storage position.

In yet another embodiment, the invention provides a tool bit case including a first housing member and a second housing member pivotally coupled together. Each housing member includes a base and sidewalls extending from the base. The tool bit case also includes a plurality of retainers located along opposing sidewalls of the first housing member. Each retainer includes a boss that extends from one of the opposing sidewalls toward the other of the opposing sidewalls. The boss defines an aperture. The tool bit case further includes a modular tool bit holder having a first projection and a second projection extending from opposite sides of the modular tool bit holder. The first projection is received in a first aperture in the one of the opposing sidewalls. The second projection is received in a second aperture in the other of the opposing sidewalls. The modular tool bit holder is selectively pivotable relative to the first housing member at the first and second projections between a storage position and an upright position.

In still another embodiment, the invention provides a tool bit case system including a first tool bit case having a first housing member and a second housing member pivotally coupled together by a first hinge. The first and second housing members define a first footprint area. The first housing member includes a first engagement member. The tool bit case system also includes a second tool bit case having a third housing member and a fourth housing member pivotally coupled together by a second hinge. The third and fourth housing members define a second footprint area that is different than the first footprint area. The fourth housing member includes a second engagement member that cooperates with the first engagement member to facilitate stacking the second tool bit case on the first tool bit case. The first hinge of the first tool bit case and the second hinge of the second tool bit case are substantially aligned in a plane when the second tool bit case is stacked on the first tool bit case.

In yet still another embodiment, the invention provides a tool bit case including a first housing member pivotally coupled to a second housing member by a hinge. The first housing member and the second housing member are movable between a closed position and an open position. The tool bit case also includes a latch mechanism disposed on the first housing member and the second housing member. The latch mechanism is operable to secure the first and second housing members in the closed position. The tool bit case further includes a first aperture formed through the first and second housing members on one side of the latch mechanism. The tool bit case further includes a second aperture formed through the first and second housing members on another side of the latch mechanism so that the latch mechanism is located between the first and second apertures.

In another embodiment, the invention provides a tool bit case including a first housing member and a second housing member pivotally coupled together by a first hinge and a second hinge. Each housing member includes a base and sidewalls extending from the base. The tool bit case also includes a recess formed in the first and second housing members between the first hinge and the second hinge. The tool bit case further includes a lip that extends from the first housing member and the second housing member. The lip defines a periphery of the recess.

In yet another embodiment, the invention provides a clamshell packaging for a tool bit case. The clamshell packaging includes a front clamshell half defining a first cavity and a rear clamshell half defining a second cavity. The front clamshell half is coupled to the rear clamshell half. The first cavity and the second cavity are configured to contain the tool bit case while the tool bit case is in an open position. The clamshell packaging also includes a plane defined by an interface between the front clamshell half and the rear clamshell half. A first portion of the tool bit case extends beyond the plane in a first direction, and a second portion of the tool bit case extends beyond the plane in a second direction.

In still another embodiment, the invention provides a tool bit case including a first housing member and a second housing member pivotally coupled together. The first housing member and the second housing member are movable between a closed position and an open position. The tool bit case also includes a threaded aperture formed in an exterior surface of the first housing member. The tool bit case further includes an accessory that engages the threaded aperture.

In yet still another embodiment, the invention provides a tool bit case including a first housing member and a second housing member pivotally coupled together. Each of housing members includes a base and sidewalls extending from the base. The first housing member includes a protrusion located on one of the sidewalls. One of the sidewalls of the second housing member includes an inner portion and an outer portion and defines a cavity between the base and the one of the sidewalls. The tool bit case also includes a latch partially received within the cavity and pivotally coupled to the second housing member. The latch is operable to selectively engage the protrusion on the first housing member to secure the first and the second housing members in a closed position.

In another embodiment, the invention provides a tool bit case including a first housing member and a second housing member pivotally coupled together. The first and second housing members each include a texturized exterior surface. The tool bit case also includes a non-texturized area formed on an exterior surface of the first housing member. The non-texturized area configured to enable writing on the tool bit case.

In yet another embodiment, the invention provides a tool bit case including a first housing member and a second housing member pivotally coupled together. Each housing member includes a base and sidewalls extending from the base. The first housing member includes an indentation area formed on an exterior surface of the base. The tool bit case also includes an indicia label coupled to the indentation area. The indicia label identifies types of tools bits located within the tool bit case.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
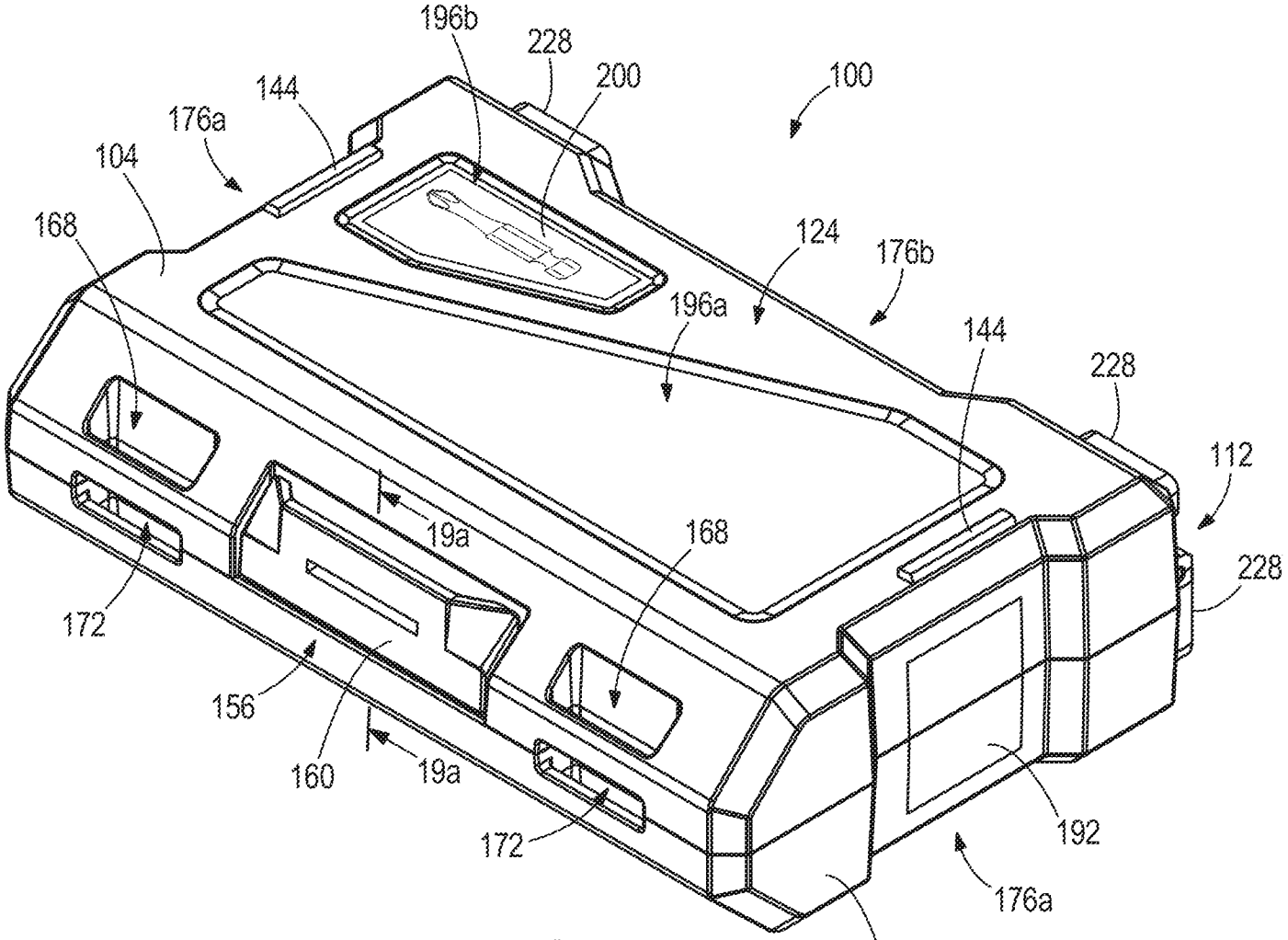
FIG. 1 is a perspective view of a tool bit case according to one embodiment of the invention, the tool bit case being in a closed position.
Figure 2:
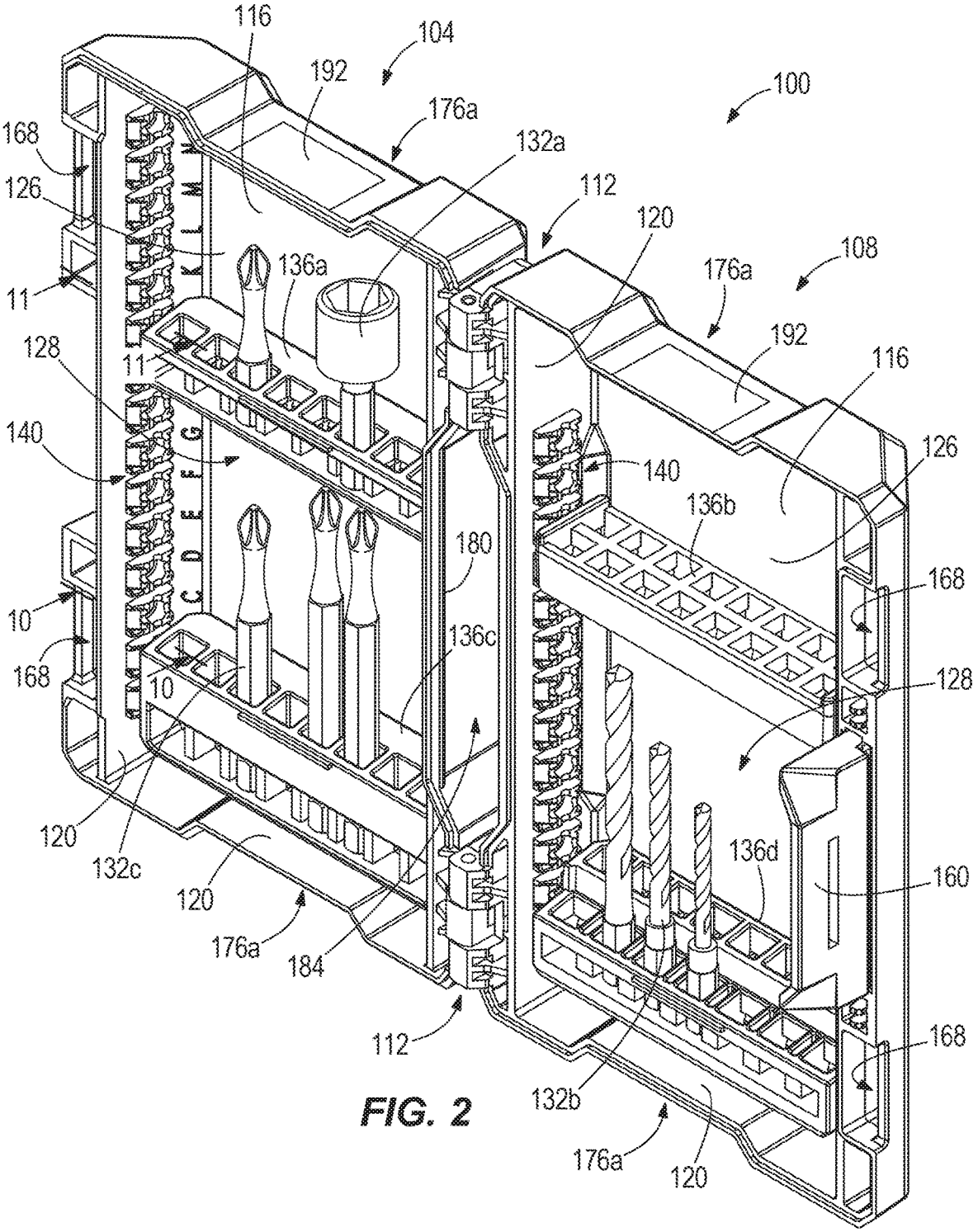
FIG. 2 is a perspective view of the tool bit case in an open position, the tool bit case including modular tool bit holders in storage positions.
Figure 3:
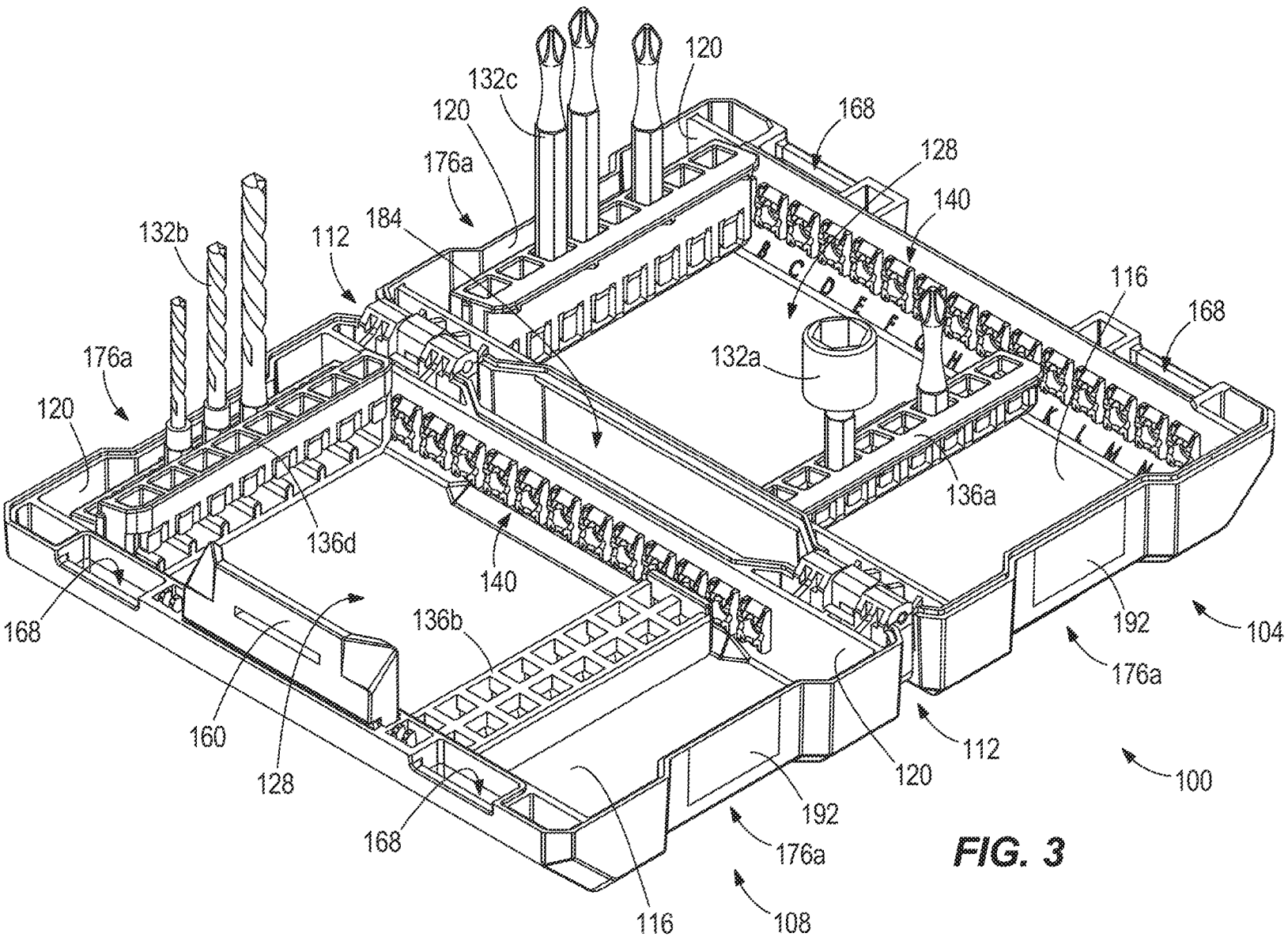
FIG. 3 is a perspective view of the tool bit case in the open position with the modular tool bit holders in upright positions.
Figure 4:
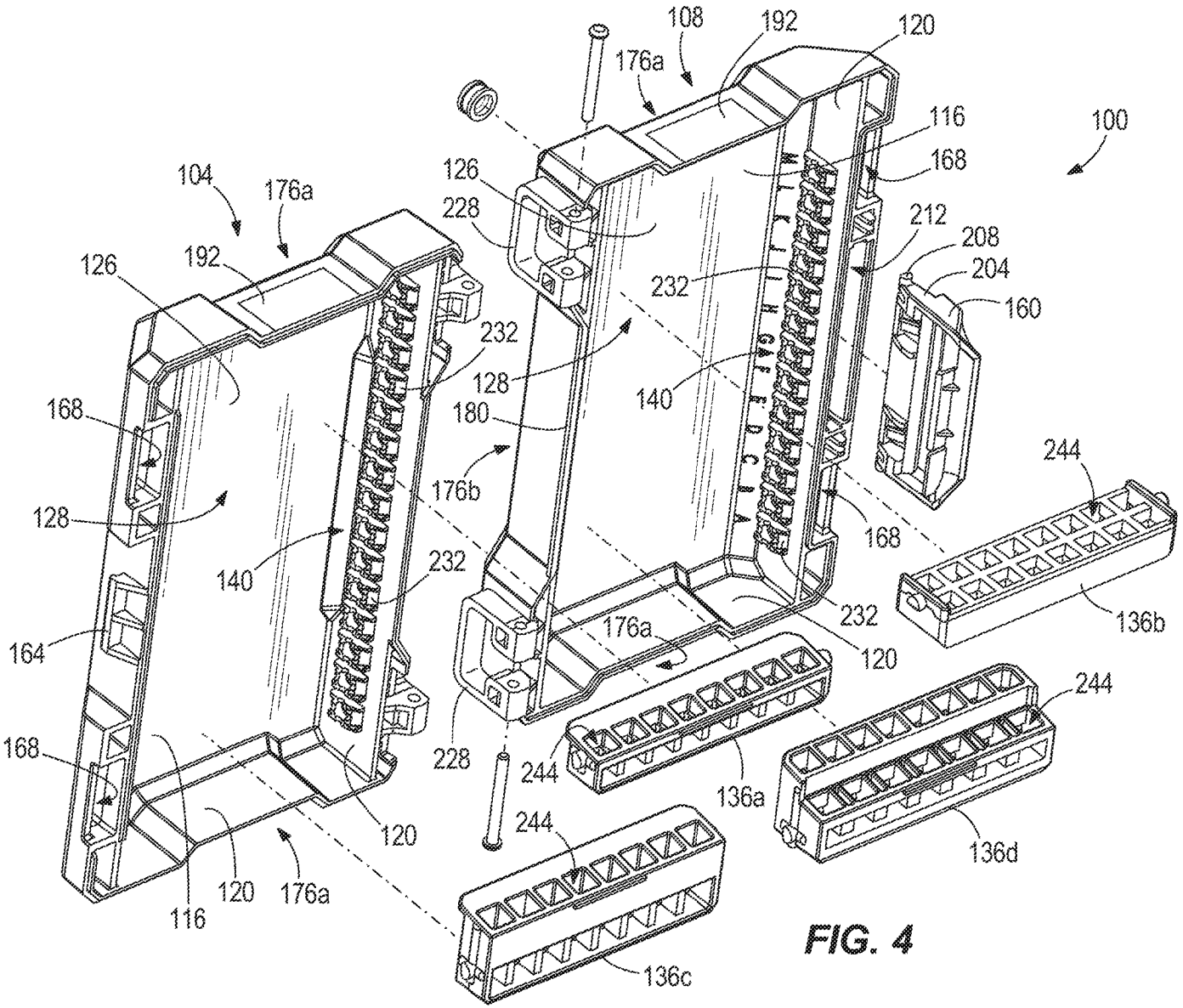
FIG. 4 is an exploded perspective view of the tool bit case.

FIGS. 1-4 illustrate a tool bit case 100 including two housing members 104, 108 pivotally coupled together by two hinges 112. In the illustrated embodiment, the first housing member 104 is a front cover, and the second housing member 108 is a rear cover. Each of the front cover 104 and the rear cover 108 includes a base 116 and sidewalls 120 that extend from and surround the base 116 (FIG. 4). In the illustrated embodiment, the sidewalls 120 are substantially perpendicular to the base 116. In addition, the front cover 104 and the rear cover 108 each include an exterior surface 124 (i.e., an outer portion) and an interior surface 126 (i.e., an inner portion). The exterior surface 124 includes the total surface area of the tool bit case 100, which also includes the outer surface of the sidewalls 120. The interior surface is defined by an interior volume 128 of the tool bit case 100. Furthermore, the front and rear covers 104, 108 are pivotable between a closed position (FIG. 1) and an open position (FIGS. 2 and 3). When in the closed position, the sidewalls 120 of both the front and rear covers 104, 108 abut each other and enclose the interior volume 128. When in the open position, the sidewalls 120 of both the front and rear covers 104, 108 are moved away from each other to allow access to the interior volume 128.

As illustrated in FIGS. 2 and 3, the tool bit case 100 retains and organizes multiple types of tool bits 132*a-c* within the interior volume 128. For example, the tool bit case 100 retains various sizes of drill bits, impact bits, socket bits, and the like. The tool bits 132*a-c* are received in modular tool bit holders 136*a-d* that are pivotally coupled to retainers 140. The modular tool bit holders 136*a-d* are movable between a storage position (FIG. 2) or an upright, in-use position (FIG. 3). The retainers 140 are located within the interior volume 128 on the sidewalls 120 of the front and rear covers 104, 108. The modular tool bit holders 136*a-d* are multi-positionable relative to the covers 104, 108 to obtain different organization configurations (e.g., to support and store different sizes or types of tool bits 132*a-c*). In addition, the illustrated modular tool bit holders 136*a-d* are snapped into place within the tool bit case 100 so that the holders 136*a-d* can be removed and repositioned to achieve different configurations.

When the modular tool bit holders 136*a-d* are in the storage position (FIG. 2), the modular tool bit holders 136*a-d* lay flat on the interior surface 126 of the base 116. In other words, the longitudinal axes of the tool bits 132*a-c* within the modular tool bit holders 136*a-d* are generally parallel to a plane defined by the interior surface 126. In addition, the modular tool bit holders 136*a-d* do not extend beyond upper edges—opposite the base 116—of the sidewalls 120. The modular tool bit holders 136*a-d* are contained within the interior volume 128 of either of the covers 104, 108. Therefore, the tool bit case 100 can be closed when all of the modular tool bit holders 136*a-d* are in the storage position.

When the modular tool bit holders 136*a-d* are in the upright position (FIG. 3), the modular tool bit holders 136*a-d* are rotated 90 degrees to extend perpendicularly from the interior surface 126 of the base 116. In other words, the longitudinal axes of the tool bits 132*a-c* within the modular tool bit holders 136*a-d* are generally perpendicular to a plane defined by the interior surface 126. In addition, portions of some of the modular tool bit holders 136*c-d* extend beyond the upper edges of the sidewalls 120 and out of the interior volume 128 of the corresponding cover 104, 108. Therefore, the tool bit case 100 cannot be closed when at least one modular tool bit holder 136*c-d* is in the upright position.

Figure 9:
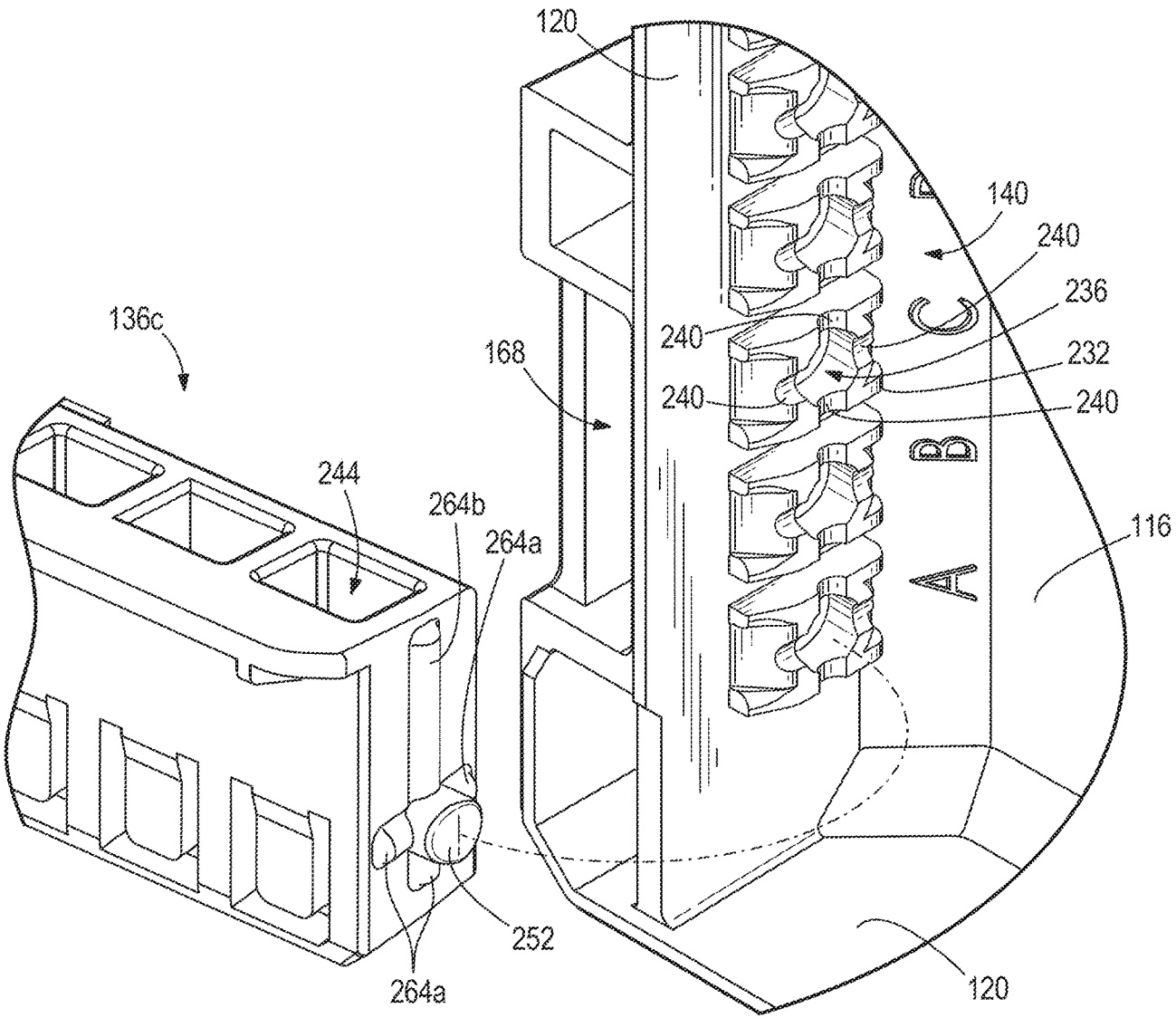
FIG. 9 is a partially exploded view of a modular tool bit holder coupled to the tool bit case.

In reference to FIG. 4, the retainers 140 are aligned in series on each opposing sidewalls 120 of the front and the rear covers 104, 108. In the illustrated embodiment, the retainers 140 are equally spaced from each other. In addition, each retainer 140 on the sidewalls 120 correspondingly aligns with another retainer 140 on the opposite sidewall 120. In other words, the retainers 140 consist in pairs along opposing sidewalls 120 of the front and the rear covers 104, 108. Each retainer 140 includes a boss 232 that extends from the sidewall 120 toward the opposing sidewall 120. Each boss 232 defines an aperture 236 (FIG. 9). The apertures 236 of corresponding bosses 232 on opposing sidewalls 120 are concentrically aligned. Furthermore, in the illustrated embodiment, each retainer 140 along one of the sidewalls 120 is identified with a letter (e.g., A-M). These letters aid in aligning modular tool bit holders 136*a-d* across the covers 104, 108.

As shown in FIG. 9, each boss 232 includes grooves 240 adjacent the aperture 236. The grooves 240 extend radially outward from corresponding apertures 236. In the illustrated embodiment, each boss 232 includes four grooves 240 that are circumferentially spaced at approximately 90 degree increments around the apertures 236. In addition, adjacent grooves 240 of adjacent bosses 232 are linearly aligned. In other embodiments, the bosses 232 may include less or more than four grooves 240, and/or the grooves 240 may be incremented at different angles.

FIGS. 5-8 illustrate different types of the modular tool bit holders 136*a-d* that can be selectively coupled to the retainers 140. Each modular tool bit holder 136*a-d* includes multiple discrete compartments 244 able to receive different tool bits 132*a-c*. Each discrete compartment 244 includes a resilient finger 248 (FIG. 5) that extends from one side of the discrete compartments 244. In the illustrated embodiment, the fingers 248 are cantilevered tabs. The fingers 248 engage the tool bits 132*a-c* to help secure the tool bits 132*a-c* within the modular tool bit holders 136*a-d*. In addition, each of the modular tool bit holders 136*a-d* include two projections 252 that extend outwardly from side surfaces of the modular tool bit holders 136*a-d*. The illustrated projections 252 are generally cylindrical in shape.

Figure 5:
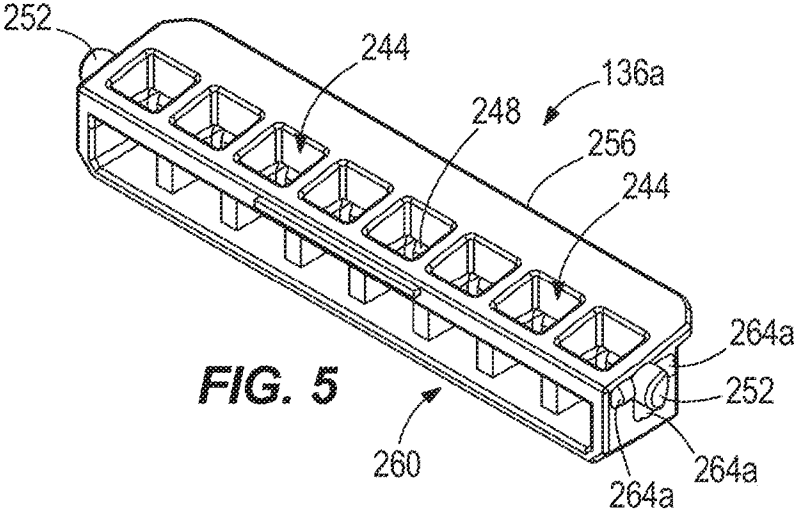

As shown in FIG. 5, the modular tool bit holder 136*a* includes one row of discrete compartments 244. In addition, the modular tool bit holder 136*a* includes a flange 256 that inhibits over-pivoting of the modular tool bit holder 136*a* past the storage position. The modular tool bit holder 136*a* defines an open region 260 formed in a front face of the holder 136*a*. The open region 260 extends completely through the modular tool bit holder 136*a*. Furthermore, the modular tool bit holder 136*a* includes ribs 264*a* adjacent each projection 252. The ribs 264*a* extend radially outward from the corresponding projection 252. In addition, the ribs 264*a* are configured to fit within the grooves 240 of the retainers 140. In the illustrated embodiment, the modular tool bit holder 136*a* includes three ribs 264*a*. The ribs 264*a* are orientated at 90 degrees increments.

Figure 6:
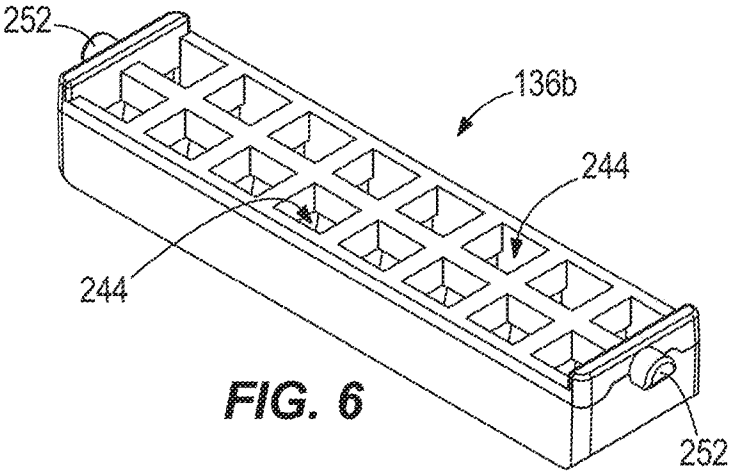
FIGS. 5-8 are perspective views of different modular tool bit holders.

With reference to FIG. 6, the modular tool bit holder 136*b* includes two rows of discrete compartments 244. The resilient fingers (not shown) are located between adjacent discrete compartments 244 of opposing rows. In the illustrated embodiment, the modular tool bit holder 136*b* does not include ribs. However, in other embodiments, the modular tool bit holder 136*b* may include ribs 264*a* adjacent the projections 252, similar to the modular tool bit holder 136*a*.

Figure 7:
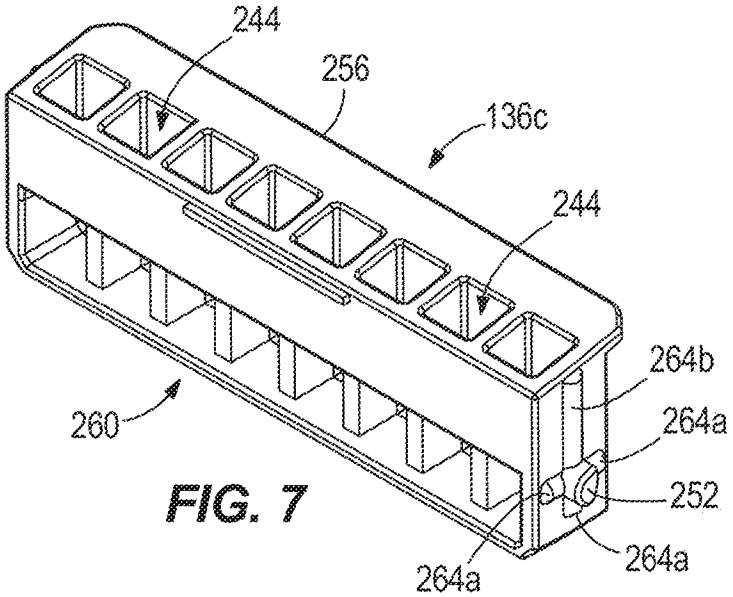

As shown in FIG. 7, the modular tool bit holder 136*c* includes one row of discrete compartments 244. In addition, the modular tool bit holder 136*c* includes ribs 264*a*, the flange 256, and the open region 260 similar to the modular tool bit holder 136*a*. In contrast to the modular tool bit holder 136*a*, the modular tool bit holder 136*c* includes an elongated rib 264*b* adjacent the projections 252. The elongated rib 264*b* extends at a greater length from the projections 252 than the ribs 264*a*. The illustrated elongated rib 264*b* is configured to span multiple retainers 140 and engage multiple grooves 240 when the modular tool bit holder 136*c* is in the storage position. This arrangement helps hold the modular tool bit holder 136*c* in the storage position. In addition, the modular tool bit holder 136*c* is taller than the modular tool bit holder 136*a* to receive longer tool bits 132*a-c*.

Figure 8:
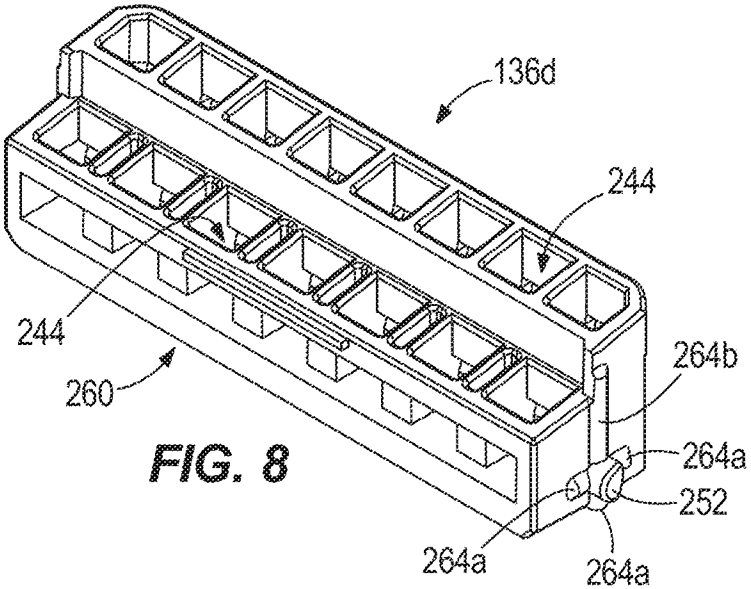

With reference to FIG. 8, the modular tool bit holder 136*d* includes two rows of discrete compartments 244. The first, or back, row is taller than the second, or front, row such that the first row is able to receive longer tool bits 132*a-c* than the second row. Similar to the modular tool bit holder 136*c*, the modular tool bit holder 136*d* includes the open region 260, the ribs 264*a*, and the elongated rib 264*b* adjacent the projections 252. In addition, the second row of discrete compartments 244, which is shorter than the first row, includes the resilient fingers (not shown) at an interface between the first and the second rows. The first row of discrete compartments 244 includes the resilient fingers opposite the interface between the rows.

Figure 11:
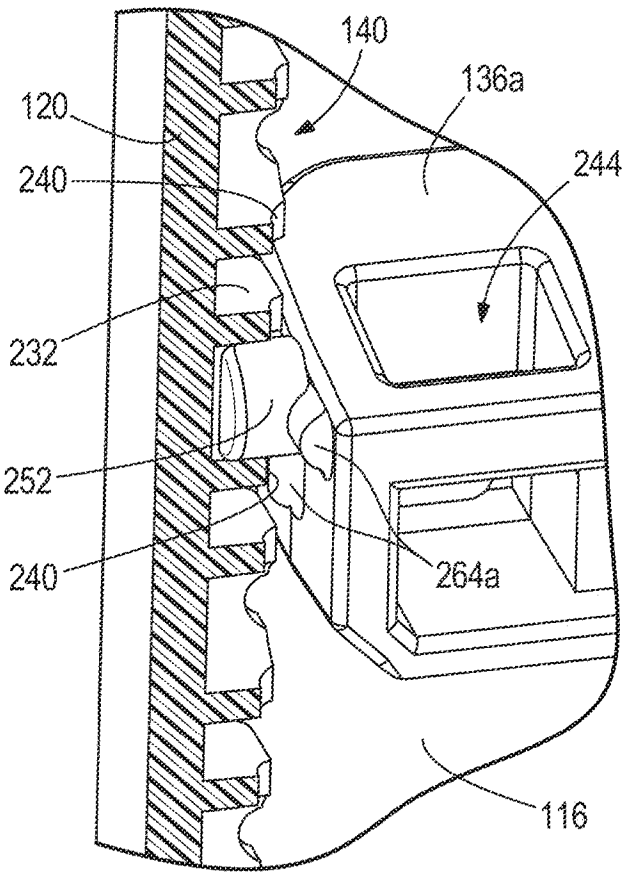
FIGS. 10-11 are partial cross-sectional views of modular tool bit holders coupled to the tool bit case.
Figure 10:
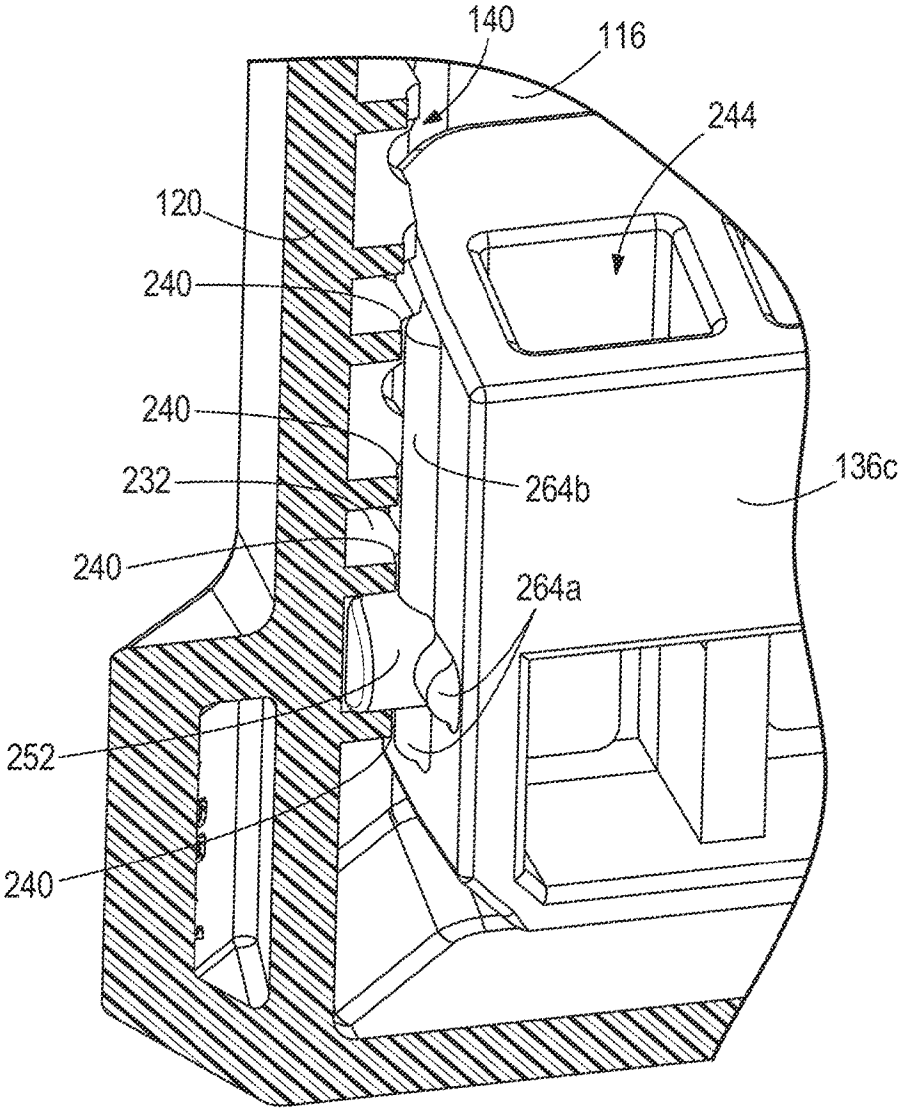

In operation, the modular tool bit holders 136*a-d* are pivotally coupled to any pair of retainers 140 within the covers 104, 108 either in the storage position or the upright position. As shown in FIGS. 9-11, the projections 252 and the ribs 264*a-b* of the modular tool bit holders 136*a-d* are received in and engage the apertures 236 and the grooves 240, respectively, of the retainers 140 to releasably secure the holders 136*a-d* within the case 100.

As shown in FIG. 11, when the modular tool bit holder 136*a* is in the storage position, at least one of the ribs 264*a* engages a corresponding groove 240 such that the discrete compartments 244 are orientated parallel relative to the base 116. In addition, the modular tool bit holder 136*a* blocks access to at least one pair of adjacent retainers 140 relative to the retainer 140 that the modular tool bit holder 136*a* engages. For example, the modular tool bit holder 136*a* engages one pair of retainers 140 by the engagement between the projections 252 and the apertures 236. However, the retainer 140 below the engaged retainer 140 is at least partially blocked by a lower portion of the modular tool bit holder 136*a*, inhibiting another modular tool bit holder 136*a-d* from engaging the retainer 140 below the engaged retainer 140. In some embodiments, the retainer 140 above the engaged retainer 140 may also or alternatively be at least partially blocked by an upper portion of the modular tool bit holder 136*a*, inhibiting another modular tool bit holder 136*a-d* from engaging the retainer 140 above the engaged retainer 140.

In contrast, when the modular tool bit holder 136*a* is in the upright position, other ribs 264*a* engage the grooves 240 such that the discrete compartments 244 are orientated perpendicular to the base 116. In addition, the same retainer 140 that is blocked when the modular tool bit holder 136*a* is in the storage position is now accessible when the modular tool bit holder 136*a* is in the upright position. This arrangement of the retainers 140 located in close proximity is advantageous to allow for greater customization of the tool bit case 100. In other words, the greater the number of retainers 140 within the covers 104, 108, the tool bit case 100 yields more combinations and configurations of the modular tool bit holders 136*a-d* and ultimately more combinations and configurations of the tool bits 132*a-c*, rather than only allowing the tool bits 132*a-c* to be positioned in a few discrete positions. In addition, the ribs 264*a* and the grooves 240 act as detent-like mechanisms to releasably secure the modular tool bit holder 136*a* in both the storage position and the upright position. The ribs 264*a* and the grooves 240 also provide positive tactile feedback to a user that the modular tool bit holder 136*a* is fully in either position.

Because the modular tool bit holder 136*b* does not include ribs 264*a-b* in the illustrated embodiment, the projections 252 of the modular tool bit holder 136*b* only engage the apertures 236 of a pair of bosses 232. Therefore, the modular tool bit holder 136*b* is dependent upon friction to maintain the modular tool bit holder 136*b* in the storage position or the upright position. For example, the side surfaces of the modular tool bit holder 136*b* adjacent the projections 252 contact the corresponding retainer 140 such that the modular tool bit holder 136*b* is fixed in a position. In some embodiments, the modular tool bit holder 136*b* is fixed in either the storage position or the upright position, and is not rotatable between the positions. For example, the modular tool bit holder 136*b* may be maintained in the position shown in FIG. 3 due to lack of clearance to physically rotate the tool bit holder 136*b*. In other embodiments, the modular tool bit holder 136*b* may be maintained in the position shown in FIG. 2 and physically wedged against the inner surface 126 to inhibit rotation.

When the modular bit holder 136*b* is in the storage position, the modular tool bit holder 136*b* blocks access to at least one pair of adjacent retainers 140 relative to the retainer 140 that the modular tool bit holder 136*b* engages. For example, the modular tool bit holder 136*b* engages one pair of retainers 140 by engagement between the projections 252 and the apertures 236. However, the retainer 140 below the engaged retainer 140 is blocked by a lower portion of the modular tool bit holder 136*b* inhibiting another modular tool bit holder 136*a-d* from engaging the retainer 140 below the engaged retainer 140. In addition, when the modular tool bit holder 136*b* is in the upright position, the two adjacent retainers 140 relative to the engaged retainer 140 are blocked due to the double row configuration of the discrete compartments 244.

When the modular tool bit holders 136*c-d* are in the storage position, the ribs 264*a-b* engage corresponding grooves 240 such that the discrete compartments 244 are orientated parallel relative to the base 116. In addition, the modular tool bit holders 136*c-d* blocks access to at least two pairs of adjacent retainers 140 relative to the retainer 140 that the modular tool bit holders 136*c-d* engage. For example, as shown in FIG. 10, the modular tool bit holder 136*c* engages one pair of retainers 140 by the engagement between the projections 252 and the apertures 236. However, the retainers 140 above and below the engaged retainer 140 are blocked by lower and upper portions of the modular tool bit holder 136*c*, inhibiting another modular tool bit holder 136*a-d* from engaging the retainers 140 below and above the engaged retainer 140. In contrast, when the modular tool bit holders 136*c-d* are in the upright position, the ribs 264*a-b* engage the grooves 240 such that the discrete compartments 244 are orientated perpendicular to the base 116. In addition, when the modular tool bit holder 136*c* is in the upright position, the retainers 140 that are blocked when the modular tool bit holder 136*c* is in the storage position are accessible. However, when the modular tool bit holder 136*d* is in the upright position, the two adjacent retainers 140 relative to the engaged retainer 140 are still blocked due to the double row configuration of the discrete compartments 244.

With continued reference to FIG. 10, the elongated rib 264*b* of the modular tool bit holder 136*c* also engages at least some of the grooves 240 of the adjacent retainer 140 when the tool bit holder 136*c* is in the storage position. Such an arrangement provides extra securement between the modular tool bit holder 136*c* and the retainers 140 to releasably secure the tool bit holder 136*c* in the storage position.

The modular tool bit holders 136*a-d* can receive any combination of tool bits 132*a-c*. When the tool bits 132*a-c* are inserted into the discrete compartments 244, the resilient fingers 204 engage a portion of the tool bits 132*a-c* such that the tool bits 132*a-c* are secured in the modular tool bit holders 136*a-d* until the user removes (e.g., pulls) the tool bits 132*a-c* from the modular tool bit holders 136*a-d*. In other words, the resilient fingers 204 provide enough force on the tool bits 132*a-c*, relative to the force of gravity and typical forces during transportation of the tool bit case 100, to retain the tool bits 132*a-c* within the modular tool bit holders 136*a-d*.

Figure 12:
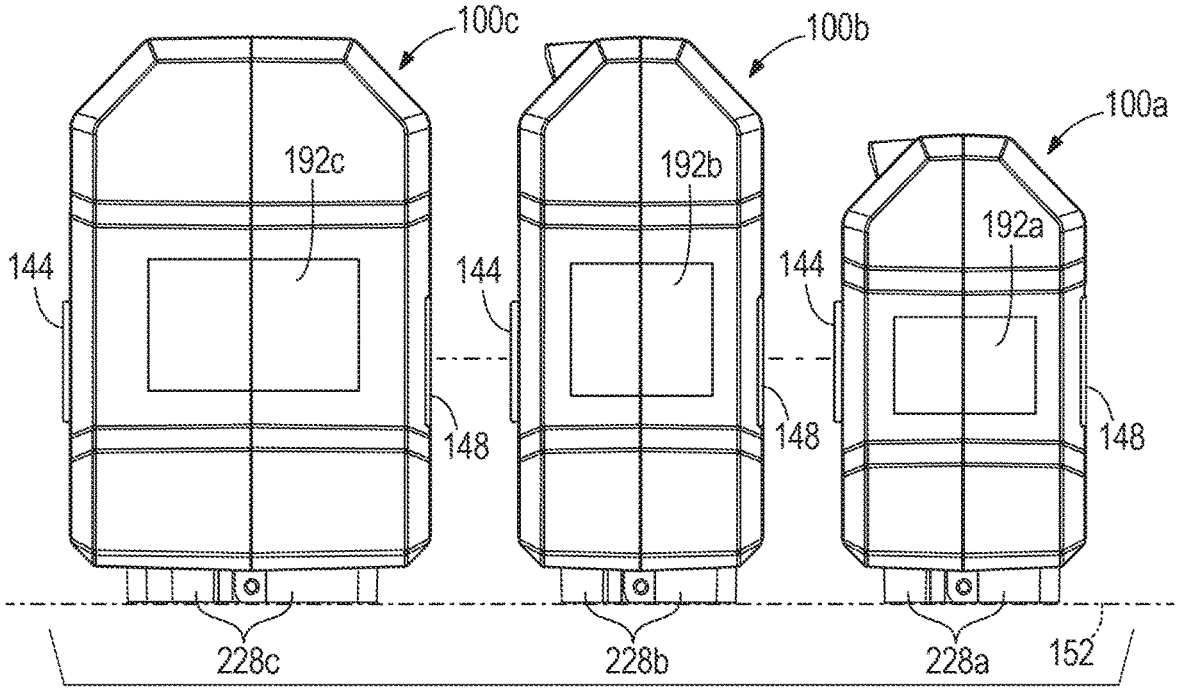
FIG. 12 is an exploded side view of different sized tool bit cases coupled to each other.
Figure 13:
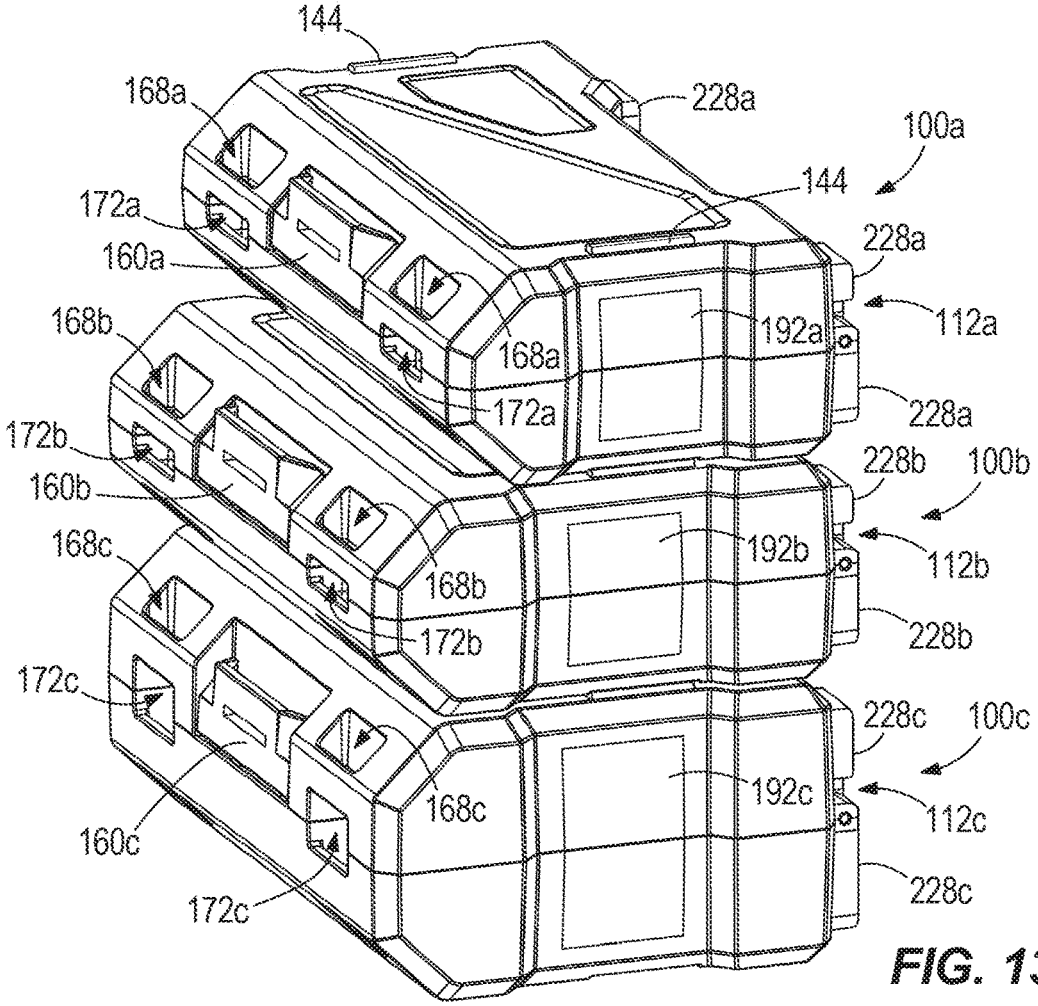
FIG. 13 is a perspective view of the different sized tool bit cases of FIG. 12 stacked on top of each other.

As illustrated in FIGS. 12-13, the tool bit case 100 is stackable with other tool bit cases 100*a-c* of different sizes. In particular, the tool bit case 100*a* defines a first footprint area, the tool bit case 100*b* defines a second footprint area that is different (e.g., larger) than the first footprint area, and the tool bit case 100*c* defines a third footprint area that is different (e.g., larger) than the first and the second footprint areas. The first, the second, and the third footprints are defined by the perimeter of the exterior surface 124 of the tool bit cases 100*a-c* when the cases 100*a-c* are in the closed positions. In other embodiments, the tool bit cases 100*a-c* may be sized similar such that the same sized tool bit cases are stackably coupled together.

Each tool bit case 100*a-c* includes engagement members 144, 148. In the illustrated embodiment, the first engagement members 144 are elongated protrusions formed on the front covers 104*a-c*, and the second engagement members 148 are elongated slots formed on the rear covers 108*a-c*. Each tool bit case 100*a-c* includes two elongated slots and two elongated protrusions. In other embodiments, relative locations of the elongated slots and elongated protrusions may be reversed. Once the tool bit cases 100*a-c* are stacked together, the tool bit cases 100*a-c* align on a common plane 152, regardless of the sizes of the cases 100*a-c*.

The stackability of the tool bit case 100 is dependent upon the engagement between the respective elongated slots 148 and the elongated protrusions 144. In the illustrated embodiment, the tool bit case 100 includes two elongated slots 148, which are located on the rear cover 108. The elongated slots 148 are orientated parallel to each other. In addition, two elongated protrusions 144 are located on the front cover 104. The elongated protrusions 144 are orientated parallel to each other. The engagement between the elongated protrusions 144 and the corresponding elongated slots 148 is characterized by a frictional interference fit. In other words, the tool bit cases 100*a-c* are able to be nested together (e.g., for transportation or storage) and are also able to be individually separated to operate as one tool bit case. When the tool bit cases 100*a-c* are stacked together, the hinges 112*a-c*, or spines, of the cases 100*a-c* align on the plane 152.

In addition, the hinges 112 define support structures 228 able to support the tool bit case 100 on the plane 152, such as a table, when the tool bit case 100 is in the closed position (FIG. 12). Furthermore, when the tool bit cases 100*a-c* are coupled together, the support structures 228*a-c* are aligned on the plane 152. When the tool bit case 100 is in the open position, a portion of the support structures 228 is received within a portion of itself such that the tool bit case 100 is able to lay flat. In other words and in reference to FIG. 17, a first portion of the support structure 228 is generally outlined in a T-shaped manner, and a second portion of the support structure 228 is able to receive the first portion when the tool bit case 100 is in the open position.

In operation of stacking the tool bit cases 100*a-c*, any combination of tool bit cases 100*a-c* are able to be stacked and coupled to each other. The user of the tool bit cases 100*a-c* aligns the elongated protrusions 144 of a tool bit case 100*a-c* to the elongated slots 148 of another tool bit case 100*a-c* such that both tool bit cases 100*a-c* are nested to each other to inhibit relative sliding between the cases 100*a-c*. Due to the positioning of the protrusions 144 and the slots 148 on the cases 100*a-c*, the cases 100*a-c* may be stacked in any order, yet still align along the plane 152. For example, the largest case 100*c* may be stacked on top of the smallest case 100*a* using the protrusions 144 and the slots 148. Since the hinges 112*a*, 112*c* remain aligned on the plane 152, the center of gravity of largest case 100*c* remains within the footprint area of the smallest case 100*a* so that the largest case 100*c* will not easily tip off of the smallest case 100*a*.

Figure 14:
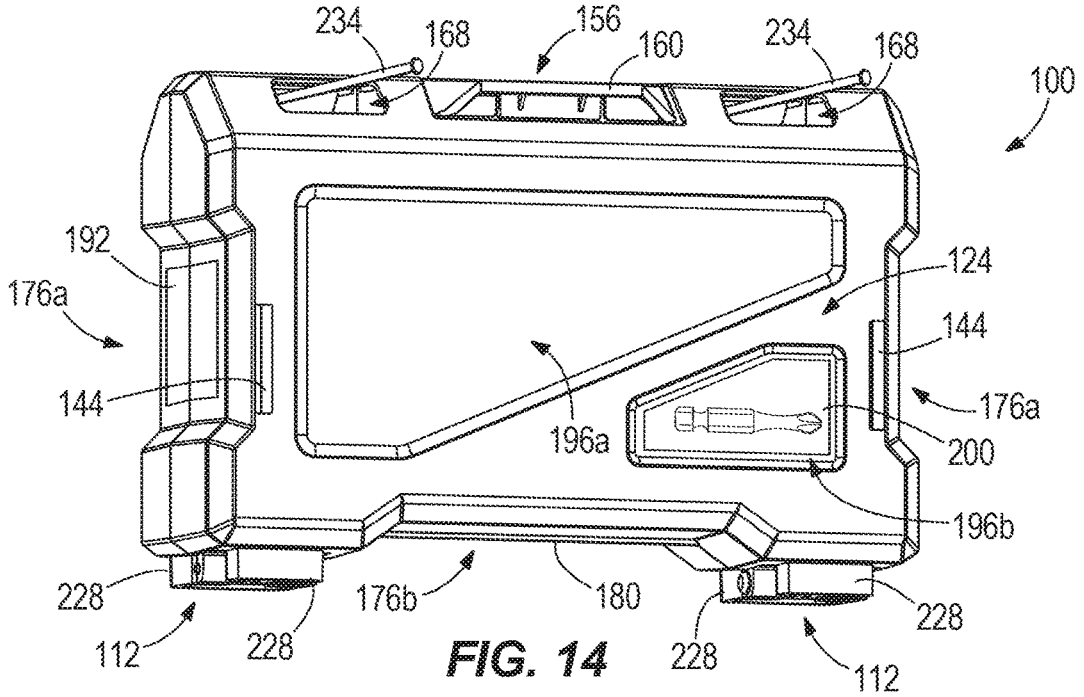
FIG. 14 is a perspective view of the tool bit case supported by support members when in the closed position.
Figure 15:
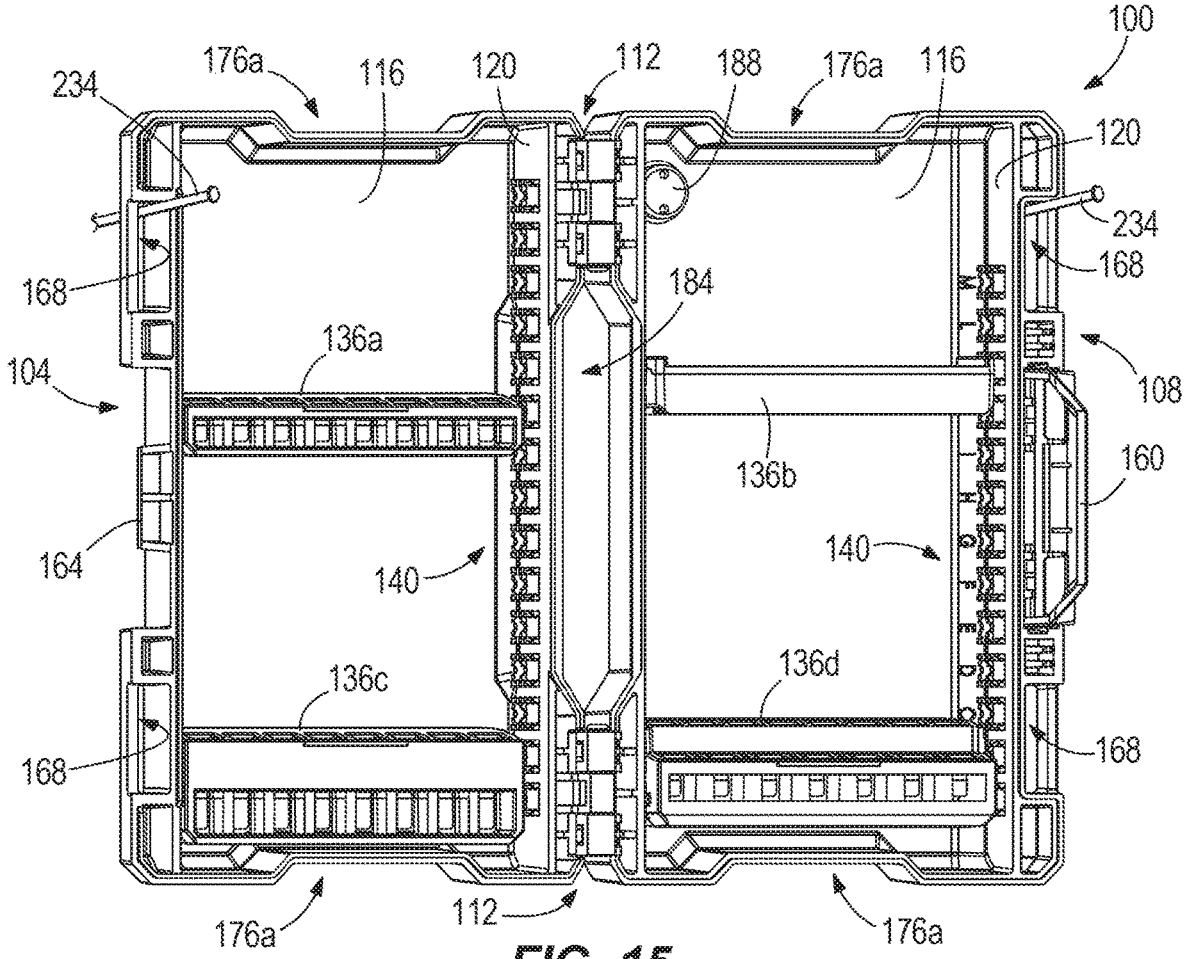
FIG. 15 is a perspective view of the tool bit case supported by support members when in the open position.

As shown in FIGS. 14-15, the front and the rear covers 104, 108 each include hanging apertures 168 adjacent a latch mechanism 156. The latch mechanism 156 is, thereby, positioned between the hanging apertures 168. In the illustrated embodiment, the hanging apertures 168 are substantially rectangular in cross-section. In other embodiments, the hanging apertures 168 may be a different geometry (e.g., circular, trapezoidal, ellipse, etc.). In addition, when the tool bit case 100 is in the open position (FIG. 15), the tool bit case 100 includes four apertures 168. Specifically, two apertures 168 are located on the front cover 104, and two apertures 168 are located on the rear cover 108. However, when the tool bit case 100 is in the closed position (FIG. 14), corresponding apertures 168 of the front and the rear covers 104, 108 align to form two apertures 168. Furthermore, when the tool bit case 100 is in the closed position, secondary hanging apertures 172 form on a top surface of the tool bit case 100 (FIG. 1). The secondary hanging apertures 172 are formed on one of the sidewalls 120 between each hanging aperture 168. In the illustrated embodiment, the secondary hanging apertures 172 are substantially rectangular in shape. In other embodiments, the secondary hanging apertures 172 may be a different geometry.

In operation of the hanging apertures 168 and in reference to FIGS. 14 and 15, the tool bit case 100 is suspended from a vertical surface (e.g., a wall) using hanging members 234 such as nails, rope, hooks, wire, and the like. For example, the tool bit case 100 is secured to a vertical wall, in the closed position, by the hanging apertures 168 receiving nails, which are fixed to the vertical wall (FIG. 14). In another example, the tool bit case 100 is secured to the vertical wall, in the open position, by a portion of the hanging apertures 168 of the covers 104, 108 receiving the nails. In other embodiments, the secondary hanging apertures 172 are used to support the tool bit case 100 in the closed position.

Figure 16:
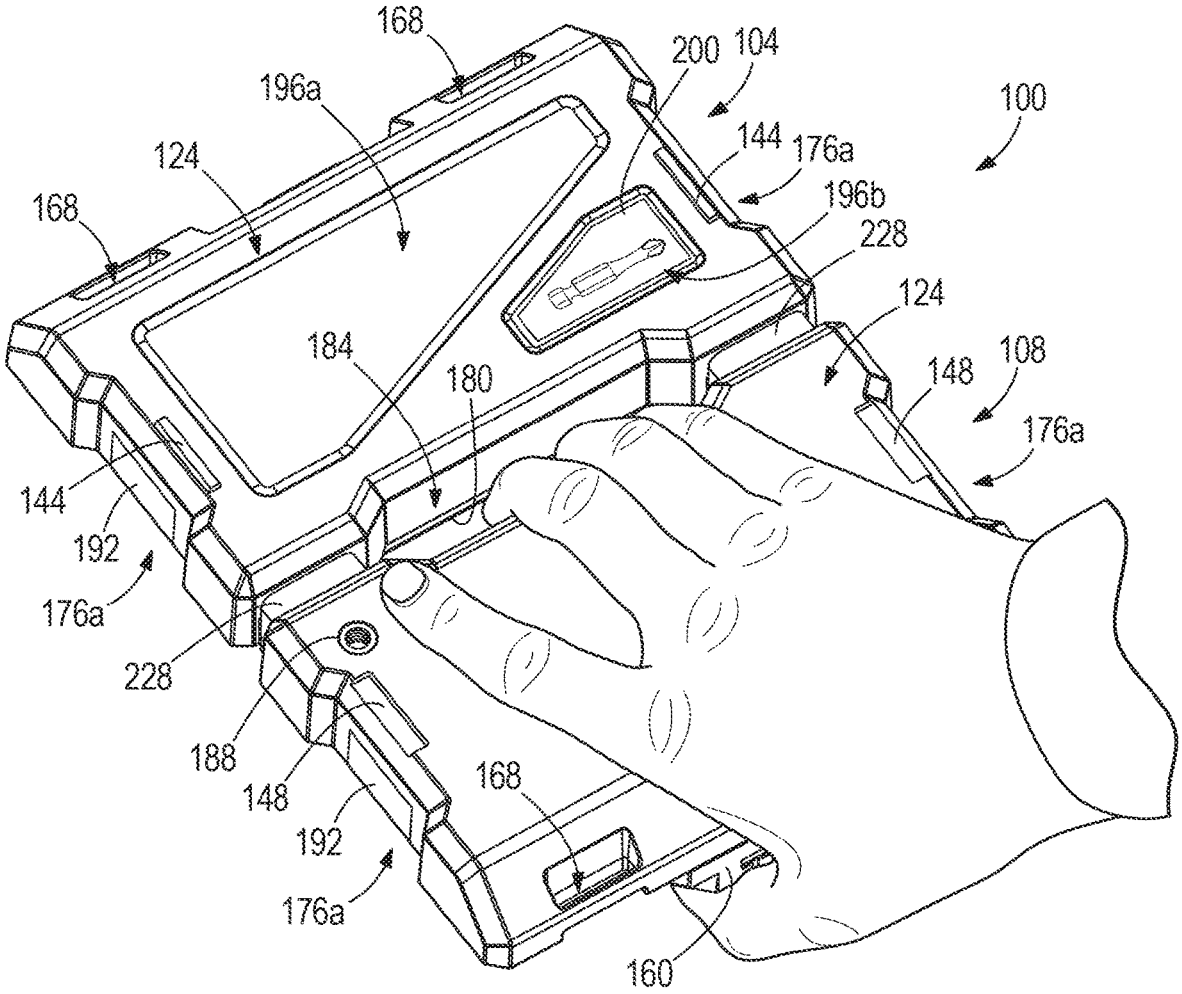
FIG. 16 is a perspective of a user gripping a portion of the tool bit case when in the open position.

In reference to FIG. 16, when the tool bit case 100 is in the open position, the tool bit case 100 defines an open region 184 between the sidewalls 120 and the hinges 112. In this arrangement, the tool bit case 100 generally has a dog bone shape. In particular, the sidewalls 120 of the front and the rear covers 104, 108 include recessed portions 176*a-b*. The recessed portions 176*a* are portions of the sidewalls 120 that are linearly offset and are adjacent the engagement members 144, 148. The recessed portions 176*b* are portions of the sidewalls 120 that are linearly offset and are defined between the hinges 112 (FIG. 1). In addition, the recessed portions 176*b* include a lip 180 that extends away from the sidewalls 120. In the illustrated embodiment, the lip 180 is located at an edge of the sidewalls 120 adjacent the interior surface 126. In other embodiments, the lip 180 may be located between the edges of the sidewalls 120. For example, the lip 180 may be located at a centerline of the sidewalls 120. Furthermore, the lip 180 is located between the hinges 112. The lip 180 generally defines a periphery of the open region 184.

With continued reference to FIG. 16, the user is able to grip the tool bit case 100 without the user's fingers being pinched between the front and the rear covers 104, 108. For example, the user grips the front cover 104 or the rear cover 108 by placing the user's fingers within the open region 184 and positioning the user's thumb opposite from the open region 184. As the tool bit case 100 is opened, the open region 184 provides clearance for the user's fingers. Because the open region 184 includes the lip 180, the lip 180 provides a stop for the user's fingers to not extend past the lip 180. Therefore, the user's fingers are inhibited from extending past the open region 184 and being pinched as the tool bit case 100 is closed.

Figure 17:
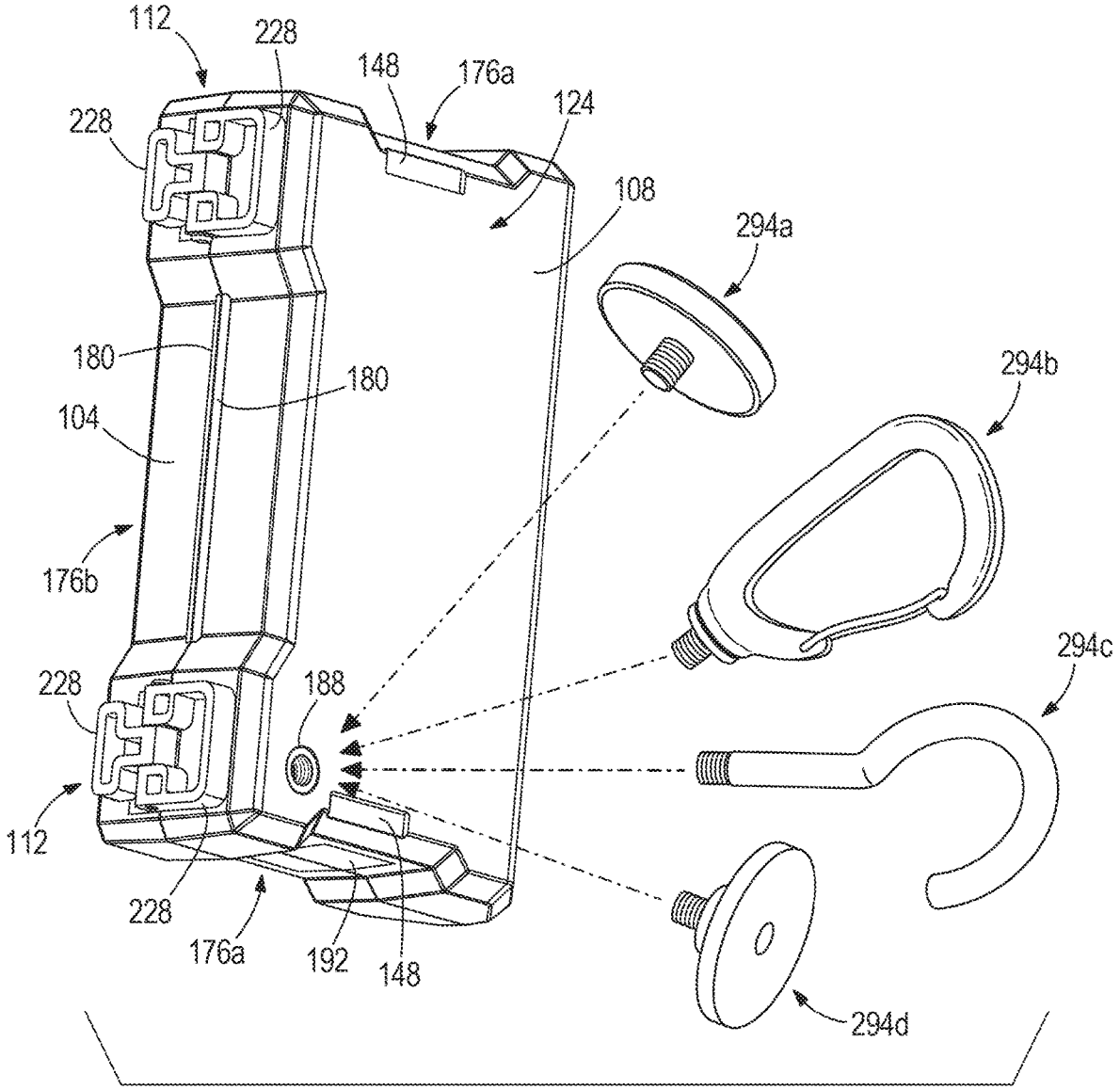
FIG. 17 is perspective view of different accessories selectively coupled to the tool bit case.

In reference to FIG. 17, the tool bit case 100 also includes an accessory insert 188 coupled to the rear cover 108. In the illustrated embodiment, the accessory insert 188 includes a threaded aperture with thread dimensions of ¼" in nominal diameter and a pitch of 20 (i.e., ¼"-20). In other embodiments, the thread pattern may be a different dimension. The accessory insert 188 is secured to the exterior surface of the rear cover 108 such that the accessory insert 188 is accessible when the tool bit case 100 is either in the open position or the closed position. Although the illustrated accessory insert 188 is located on the rear cover 108, in other embodiments, the accessory insert 188 may be located elsewhere on the tool bit case 100. For example, the accessory insert 188 may be located centrally on the rear cover 108, the accessory insert 188 may be located on the front cover 104, or the accessory insert 188 may be located on one of the sidewalls 120. In yet further embodiments, the tool bit case 100 may include multiple accessory inserts 188.

In continued reference to FIG. 17, multiple accessories 294*a-d* are selectively coupled to the accessory insert 188. In the illustrated embodiment, a magnet 294*a*, a carabineer 294*b*, a hook 294*c*, or a belt attachment 294*d* could all be connected to the tool bit case 100 using the accessory insert 188. The illustrated magnet 294*a* may support the tool bit case 100 on a ferrous material (e.g., steel). The illustrated carabineer 294*b* may be connected to another object or structure as an alternative way to hold or hang the tool bit case 100. The illustrated hook 294*c* may also hold or hang the tool bit case 100. The illustrated belt attachment 294*d* is slidably received within a holster or clip that is secured to the user (e.g., to a user's belt) to support the tool bit case 100. Although only four accessories 294*a-d* are illustrated, the tool bit case 100 is usable with many other types of accessories that can be connected to the accessory insert 188.

Figure 18:
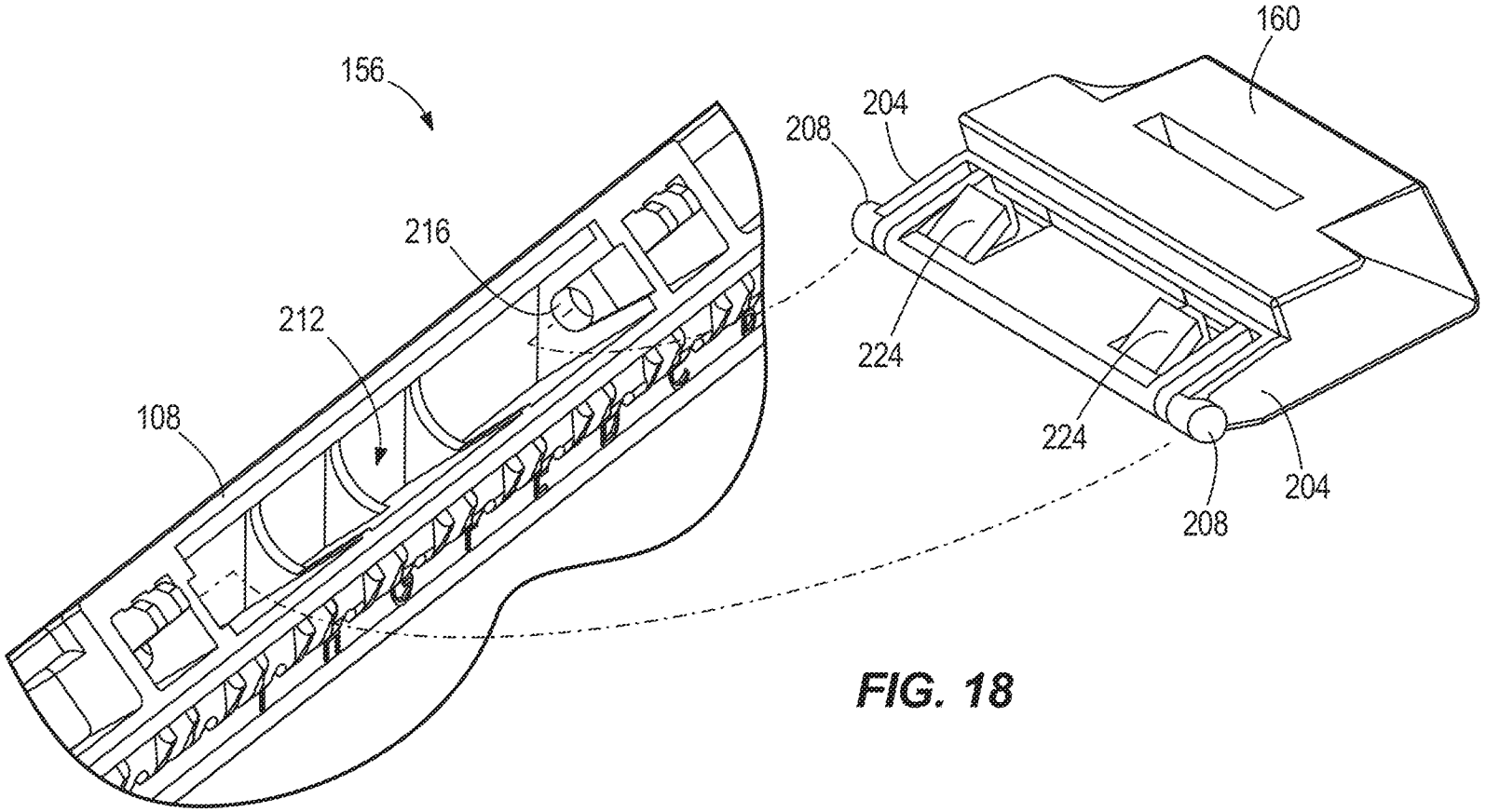
FIG. 18 is a partially exploded view of a latch mechanism of the tool bit case.
Figure 19A:
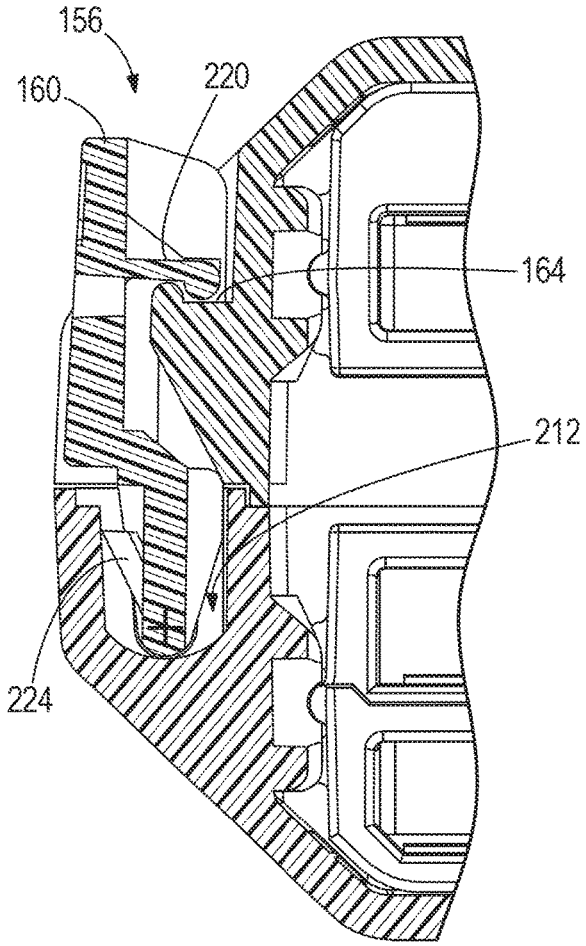
FIG. 19*a* is a cross-sectional view at line 19*a*-19*a* of FIG. 1 of the latch mechanism in a locked position.
Figure 19B:
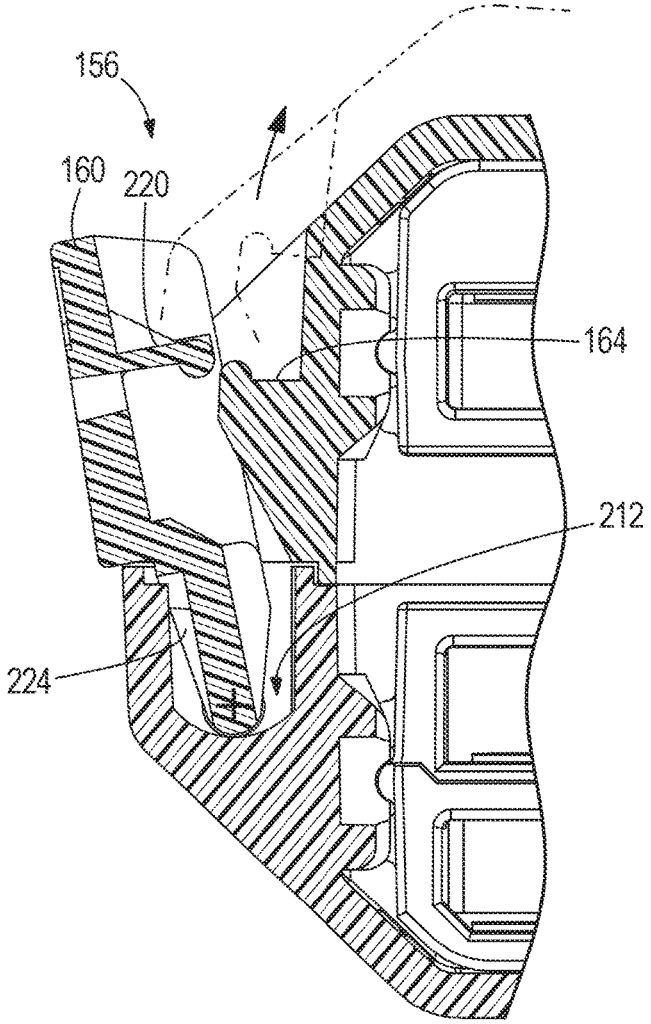
FIG. 19*b* is a cross-sectional view at line 19*a*-19*a* of FIG. 1 of the latch mechanism in an unlocked position.

In reference to FIGS. 18-19*b*, the tool bit case 100 further includes the latch mechanism 156 to selectively secure the tool bit case 100 in the closed position. Consequently, when the tool bit case 100 is in the closed position, the latch mechanism 156 can be orientated in a locked position (FIG. 19*a*). In contrast, the latch mechanism is moved to an unlocked position (FIG. 19*b*) to move the tool bit case 100 to the open position. The illustrated latch mechanism 156 includes a latch 160 that is pivotally coupled to the rear cover 108 and a locking protrusion 164 located on the front cover 104. In other embodiments, the relative positions of the latch 160 and the protrusion 164 may be reversed. The latch 160 engages the locking protrusion 164 such that the tool bit case 100 is secured in the closed position. In contrast, the latch 160 disengages from the locking protrusion 164 such that the tool bit case 100 can be opened.

The latch 160 includes resilient fingers 204 having projections 208 extending outwardly from the resilient fingers 204. A portion of the latch 160 is received within a cavity 212 of the rear cover 108. The cavity 212 includes two apertures 216 located at opposite ends of the cavity 212. The projections 208 are received in the apertures 216. The latch 160 also includes a resilient tab 220 generally located opposite from the projections 208. The resilient tab 220 is positioned on the latch 160 such that a portion of the resilient tab 220 engages a portion of the locking protrusion 164 when the latch mechanism 156 is in the locked position. Furthermore, the latch 160 includes biasing tabs 224 located adjacent the projections 208. The biasing tabs 224 contact an inner surface of the cavity 212 (FIGS. 19*a-b*) to bias the latch 160 toward the locking protrusion 164.

In operation of the latch mechanism 156, the latch 160 is selectively displaced by the user from the locked position to the unlocked position. When the latch 160 is in the locked position, the tool bit case 100 is in the closed position. The user is able to pivot the latch 160 away from the front cover 104 such that the resilient tab 220 disengages the locking protrusion 164. Then, the user is able to pivot the covers 104, 108 apart to orientate the covers 104, 108 in the open position. Once the latch 160 is displaced from the front cover 104, the resilient fingers 204 bias the latch 160 towards the locking protrusion 164 such that the user simply applies a force to the latch 160 to fully engage the resilient tab 220 and the locking protrusion 164 back to the locked position.

In reference to FIG. 1, each cover 104, 108 primarily includes a texturized exterior surface. The tool bit case 100 also includes non-texturized areas 192 formed on the exterior surface 124 of the front and the rear covers 104, 108. For example, the front cover 104 includes two non-texturized areas 192 on the sidewalls 120 of the recessed areas 176*a*, and the rear cover 108 includes two non-texturized areas 192 on the sidewalls 120 of the recessed areas 176*a* (FIG. 2). When the tool bit case 100 is in the closed position, the non-texturized areas 192 align and combine to form two non-texturized areas 192. In other embodiments, the non-texturized areas 192 may be located at different positions on the tool bit case 100. For example, the non-texturized areas 192 may be located on the exterior surface 124 of the base 116, or the non-texturized areas 192 may be located on the sidewalls 120 of one of the front or the rear covers 104, 108. In the illustrated embodiment, the non-texturized areas 192 enable a user to write on the tool bit case 100 with a writing instrument (e.g., permanent marker).

The front cover 104 of the tool bit case 100 further includes indentation areas 196*a-b* on the exterior surface 124. In the illustrated embodiment, two indentation areas 196*a-b* are located on the front cover 104. The indentation areas 196*a-b* are asymmetrical to each other. One of the indentation areas 196*a* includes markings to signify, for example, a trademarked name. The other indentation area 196*b* includes indicia 200 that identifies the tool bits 132*c* contained within the tool bit case 100. The indicia 200 easily identifies the tool bits 132*c* when the tool bit case 100 is in the closed position. In the illustrated embodiment, the indicia 200 is an adhesive label. In other embodiments, the indentation areas 196*a-b* and the corresponding indicia 200 may be located differently on the tool bit case 100. In further embodiments, the tool bit case 100 may include more than two indentation areas 196*a-b*. In further embodiments, the indentation areas 196*a-b* may be a transparent window to allow a user to see what is inside the tool bit case 100.

Figure 20:
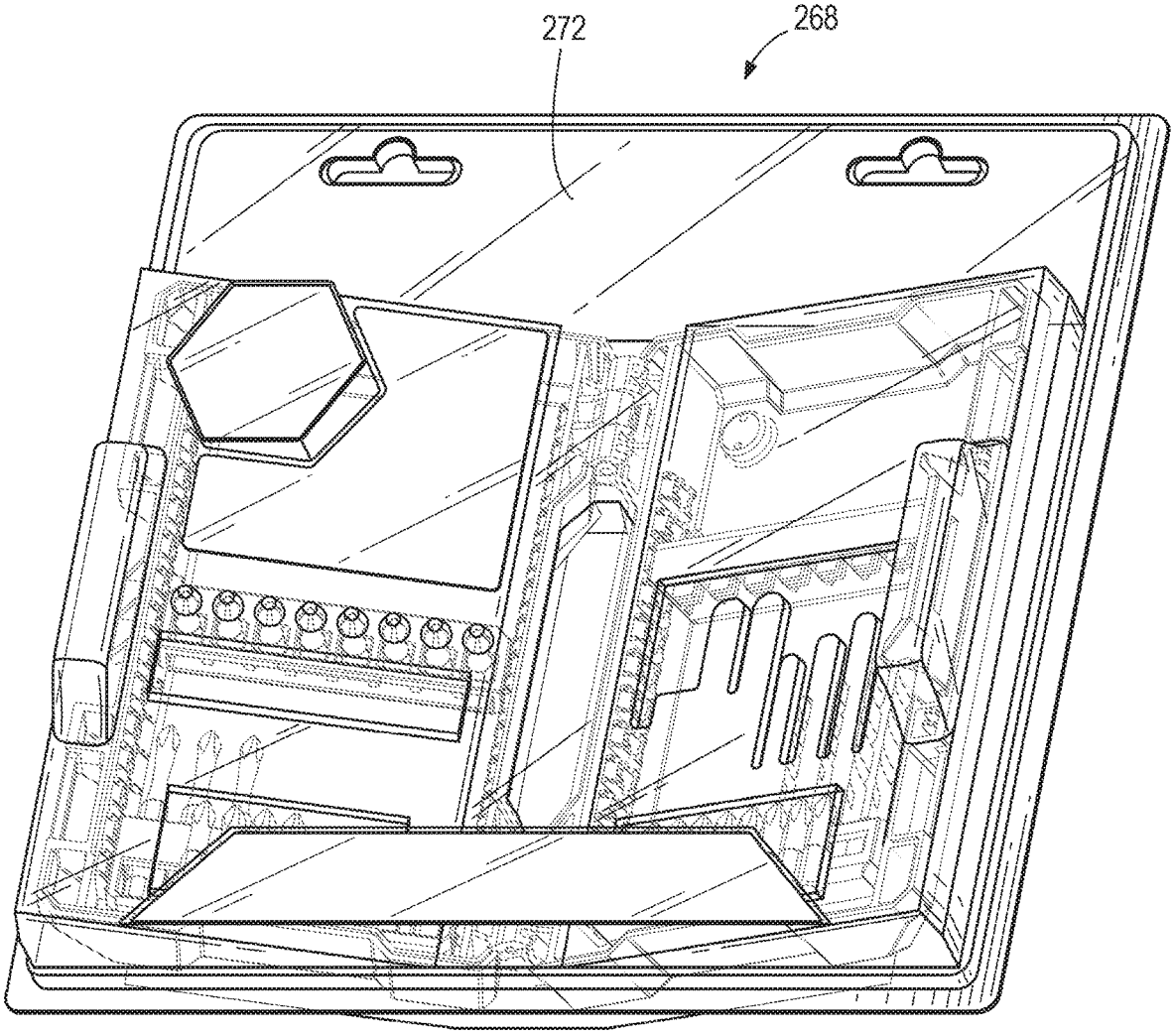
FIG. 20 is a perspective view of the tool bit case enclosed in a clamshell packaging.
Figure 21:
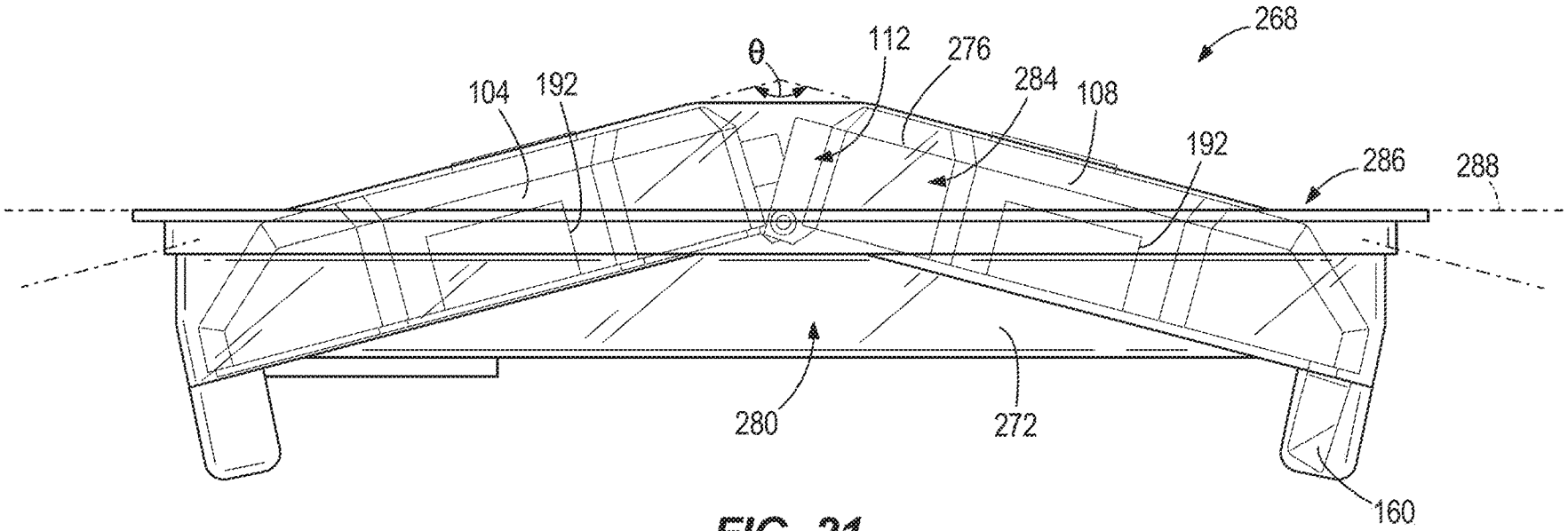
FIG. 21 is a top view of the tool bit case and the clamshell packaging.

In reference to FIGS. 20-21, the tool bit case 100 is contained within a clamshell packaging 268 to be sold as a merchandise product. The clamshell packaging 268 includes a front clamshell half 272 and a rear clamshell half 276 that completely encapsulates the tool bit case 100. In the illustrated embodiment, the front clamshell half 272 defines a first cavity 280, and the rear clamshell half 276 defines a second cavity 284. The front clamshell half 272 is coupled to the rear clamshell half 276 at an interface 286. In addition, when the front clamshell half 272 is coupled to the rear clamshell half 276, the first cavity 280 aligns with the second cavity 284 to provide sufficient volume to secure the tool bit case 100 therein. In the illustrated embodiment, the tool bit case 100 is secured within the clamshell packaging 268 while in the open position. In particular, the front cover 104 and the rear cover 108 are orientated at an angle θ. The angle θ is between about 100 degrees and 180 degrees. In the illustrated embodiment, the angle θ is about 150 degrees. In other embodiments, the front cover 104 and the rear cover 108 may be orientated at a different angle within the clamshell packaging 268.

In addition, the interface 286 between the front clamshell half 272 and the rear clamshell half 276 defines a plane 288. In other words, the plane 288 is generally between the first cavity 280 and the second cavity 284. In the illustrated embodiment, a first portion of the tool bit case 100 extends beyond the plane 288 in a first direction, and a second portion of the tool bit case 100 extends beyond the plane 288 in a second direction. For example, the hinges 112 of the tool bit case 100 are located on one side of the plane 288, and the latch 160 of the case 100 is located on the opposite side of the plane 288. Displaying the tool bit case 100 in the open position within the clamshell packaging 268 allows a consumer to simultaneously see the modular tool bit holders 136*a-d* in the storage position and the upright position (FIG. 20). In addition, the consumer can hold the tool bit case 100 without removing the tool bit case 100 from the clamshell packaging 268 to test gripping the dog bone shape (FIG. 16).

Although the invention has been described in detail with reference to certain preferred embodiments, variations and modifications exist within the scope and spirit of one or more independent aspects of the invention as described.

Various features and advantages of the invention are set forth in the following claims.

The invention claimed is:

1. A merchandise product comprising:

a tool bit case including a first housing member and a second housing member pivotally coupled together, a first modular tool bit holder movably coupled to the first housing member, the first modular tool bit holder movable between a storage position and an in-use position, and a second modular tool bit holder movably coupled to the first housing member or the second housing member, the second modular tool bit holder movable between a storage position and an in-use position; and a clamshell packaging including a front clamshell portion, and a rear clamshell portion coupled to the front clamshell portion to fully enclose the tool bit case between the front clamshell portion and the rear clamshell portion while the tool bit case is in an open position;

wherein while the tool bit case is fully enclosed by the clamshell packaging, the first modular bit holder is in the storage position and the second modular bit holder is in the in-use position.

2. The merchandise product of claim 1, wherein when the first and second modular bit holders are in the storage position, the first and second modular bit holders lay flat on an interior surface of the first or second housing members and tool bits supported by the first and second modular bit holders do not extend beyond upper edges of the first or second housing members, and wherein when the first and second modular bit holders are in the in-use position, the first and second modular bit holders extend perpendicularly from the interior surface of the first or second housing members and tool bits supported by the first and second modular bit holders extend beyond the upper edges of the first or second housing members.

3. The merchandise product of claim 1, wherein the front clamshell portion defines a first cavity that contains a portion of the tool bit case, and wherein the rear clamshell portion defines a second cavity that contains a portion of the tool bit case.

4. The merchandise product of claim 1, wherein the first and second housing members are pivotally coupled together by a hinge.

5. The merchandise product of claim 1, wherein the tool bit case further includes a latch coupled to the first housing member and selectively operable to secure the tool bit case in a closed position.

6. The merchandise product of claim 1, wherein the first modular tool bit holder supports a first tool bit, and the second modular tool bit holder supports a second tool bit different than the first tool bit.

7. The merchandise product of claim 1, wherein the first housing member and the second housing member are oriented at an oblique angle in the open position.

8. The merchandise product of claim 1, wherein the front clamshell portion is transparent, allowing a consumer to see the first and second modular bit holders through the front clamshell portion.

9. A merchandise product comprising:

a tool bit case including a first hinge and a second hinge, a first housing member and a second housing member including sidewalls pivotally coupled together by the first and second hinges, the first and second housing members moveable between an open position and a closed position, the sidewalls each including a recessed portion between the first hinge and the second hinge; and a clamshell packaging including a front clamshell portion, and a rear clamshell portion coupled to the front clamshell portion, the front and rear clamshell portions containing the tool bit case while the tool bit case is in the open position; and wherein the recessed portions of the sidewalls provide clearance for a user to grasp the first housing member while the front and rear clamshell portions contain the tool bit case in the open position.

10. The merchandise product of claim 9, wherein the tool bit case further includes a modular tool bit holder movably coupled to the first housing member.

11. The merchandise product of claim 9, wherein the front clamshell portion defines a first cavity that contains a first portion of the tool bit case, and wherein the rear clamshell portion defines a second cavity that contains a second portion of the tool bit case.

12. The merchandise product of claim 11, wherein the front and rear clamshell portions are coupled together at an interface that defines a plane between the front and rear clamshell portions, wherein the first portion of the tool bit case extends beyond the plane in a first direction, and wherein the second portion of the tool bit case extends beyond the plane in a second direction that is opposite the first direction.

13. The merchandise product of claim 9, wherein the first housing member and the second housing member are oriented at an oblique angle in the open position.

14. A merchandise product comprising:

a tool bit case including a first housing member and a second housing member pivotally coupled together by a hinge, and a latch coupled to the first housing member and selectively operable to secure the tool bit case in a closed position; and a clamshell packaging including a front clamshell portion defining a first cavity, and a rear clamshell portion defining a second cavity and coupled to the front clamshell portion at an interface, the interface defining a plane between the front clamshell portion and the rear clamshell portion, the first cavity and the second cavity containing the tool bit case while the tool bit case is in an open position, wherein the front and rear clamshell portions fully enclose the tool bit case while the tool bit case in the open position; and wherein at least a portion of the hinge is located on an opposite side of the plane relative to the latch.

15. The merchandise product of claim 14, wherein the tool bit case further includes a first modular tool bit holder movably coupled to the first housing member.

16. The merchandise product of claim 15, wherein the tool bit case further includes a second modular tool bit holder movably coupled to the second housing member.

17. The merchandise product of claim 14, wherein the first housing member and the second housing member are oriented at an oblique angle in the open position.

18. The merchandise product of claim 17, wherein the oblique angle is about 150 degrees.

19. The merchandise product of claim 14, wherein the first housing member and a second housing member include sidewalls, the sidewalls each including a recessed portion adjacent the hinge.

20. The merchandise product of claim 19, wherein the recessed portions provide clearance for a user to grasp the first housing member while the front and rear clamshell portions contain the tool bit case in the open position.

* * * * *